US009042787B2

(12) United States Patent
Nagamori et al.

(10) Patent No.: US 9,042,787 B2
(45) Date of Patent: May 26, 2015

(54) GRID ELECTRODE, CHARGING DEVICE, AND IMAGE FORMING APPARATUS

(71) Applicant: FUJI XEROX CO., LTD., Minato-ku, Tokyo (JP)

(72) Inventors: Yuki Nagamori, Kangawa (JP); Koji Otsuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 152 days.

(21) Appl. No.: 13/725,023

(22) Filed: Dec. 21, 2012

(65) Prior Publication Data

US 2013/0279939 A1 Oct. 24, 2013

(30) Foreign Application Priority Data

Apr. 23, 2012 (JP) ..... 2012-097774

(51) Int. Cl.
*G03G 15/02* (2006.01)
*H01B 5/02* (2006.01)

(52) U.S. Cl.
CPC ..... *G03G 15/0291* (2013.01); *H01B 5/02* (2013.01)

(58) Field of Classification Search
CPC ..... G03G 15/02; G03G 15/0291
USPC ..... 399/170–172
See application file for complete search history.

(56) References Cited

U.S. PATENT DOCUMENTS

2006/0002740 A1 1/2006 Tanaka et al.
2008/0253805 A1* 10/2008 Yoshino ..... 399/171

FOREIGN PATENT DOCUMENTS

JP 2005-338797 A 12/2005
JP 2008-262114 A 10/2008

* cited by examiner

*Primary Examiner* — Hoang Ngo
(74) *Attorney, Agent, or Firm* — Sughrue Mion, PLLC

(57) ABSTRACT

A grid electrode that is substantially thin-plate-shaped includes an opening section in which plural openings are formed and a frame section that surrounds the opening section. The grid electrode is curved along a short-side direction thereof and includes portions having different thicknesses, the portions being arranged in the short-side direction.

16 Claims, 30 Drawing Sheets

(ELECTRODE THICKNESS: ENTIRE AREA OF FRAME SECTION → 0.1 mm,
THICK PARTS OF OPENING SECTION → 0.1 mm,
THIN PARTS OF OPENING SECTION → 0.05 mm)
(OPENING PATTERN: MESH PATTERN OF DEFORMED HEXAGONAL OPENINGS)

(ELECTRODE THICKNESS: FRAME SECTION AND OPENING SECTION → 0.1 mm)
(OPENING PATTERN: MESH PATTERN OF DEFORMED HEXAGONAL OPENINGS)

500 μm

AXIAL DIRECTION (ELECTRODE THICKNESS: FRAME SECTION AND OPENING SECTION → 0.05 mm)
(OPENING PATTERN: MESH PATTERN OF DEFORMED HEXAGONAL OPENINGS)

500 μm

AXIAL DIRECTION (ELECTRODE THICKNESS: FRAME SECTION AND OPENING SECTION → 0.1 mm)
(OPENING PATTERN: PARALLEL LINEAR PATTERN)

GRID ELECTRODE, CHARGING DEVICE, AND IMAGE FORMING APPARATUS

CROSS-REFERENCE TO RELATED APPLICATIONS

This application is based on and claims priority under 35 USC 119 from Japanese Patent Application No. 2012-097774 filed Apr. 23, 2012.

BACKGROUND

Technical Field

The present invention relates to a grid electrode, a charging device, and an image forming apparatus.

SUMMARY

According to an aspect of the invention, there is provided a grid electrode that is substantially thin-plate-shaped and that includes an opening section having plural openings and a frame section that surrounds the opening section. The grid electrode is curved along a short-side direction thereof and includes portions having different thicknesses, the portions being arranged in the short-side direction.

BRIEF DESCRIPTION OF THE DRAWINGS

Exemplary embodiments of the present invention will be described in detail based on the following figures, wherein:

FIG. 12B is a sectional view of FIG. 11 taken along line XIIB-XIIB;

DETAILED DESCRIPTION

Exemplary embodiments of the present invention will now be described with reference to the drawings.

First Exemplary Embodiment

Figure 1:
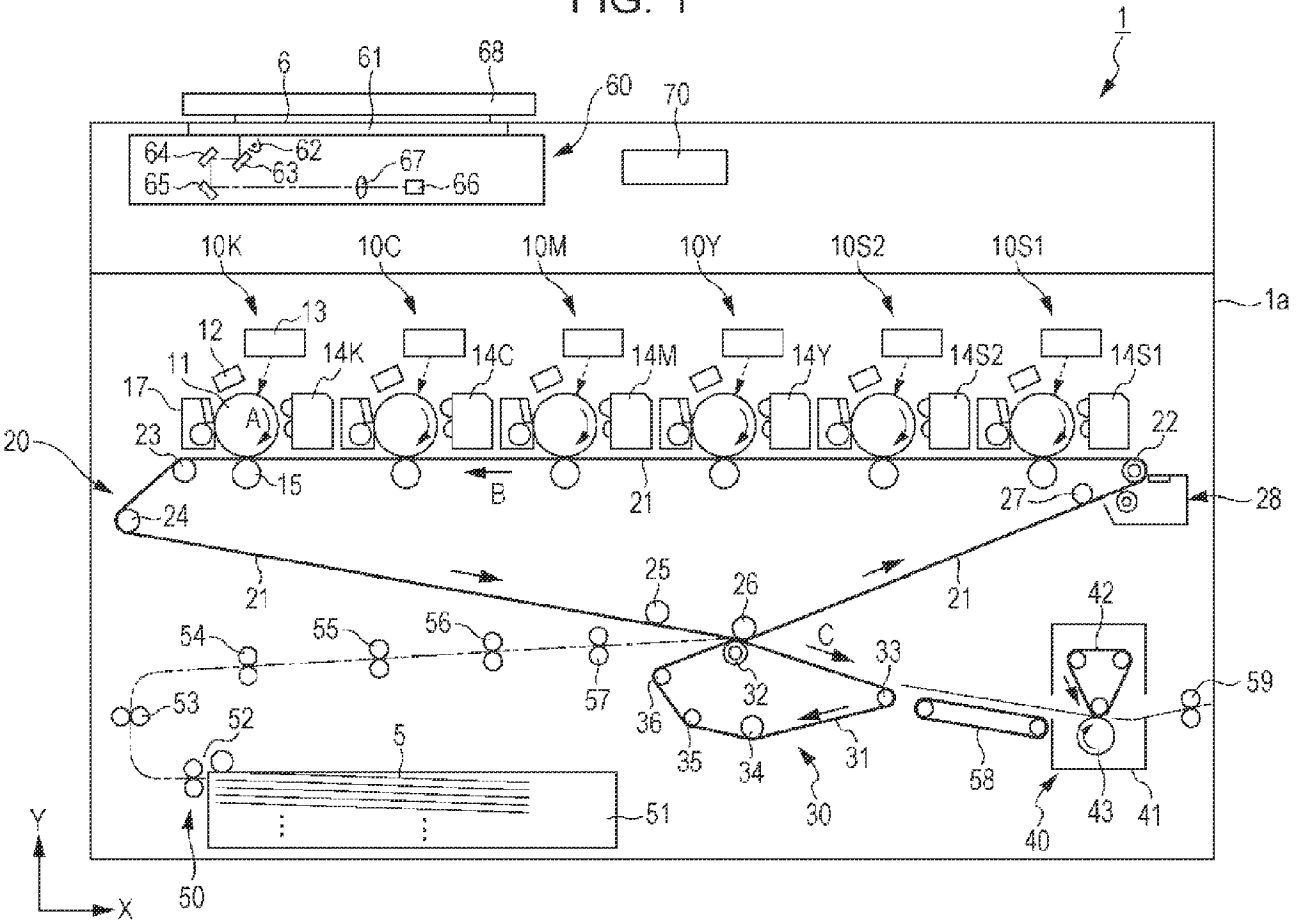
FIG. 1 illustrates an image forming apparatus including a charging device according to a first exemplary embodiment.
Figure 2:
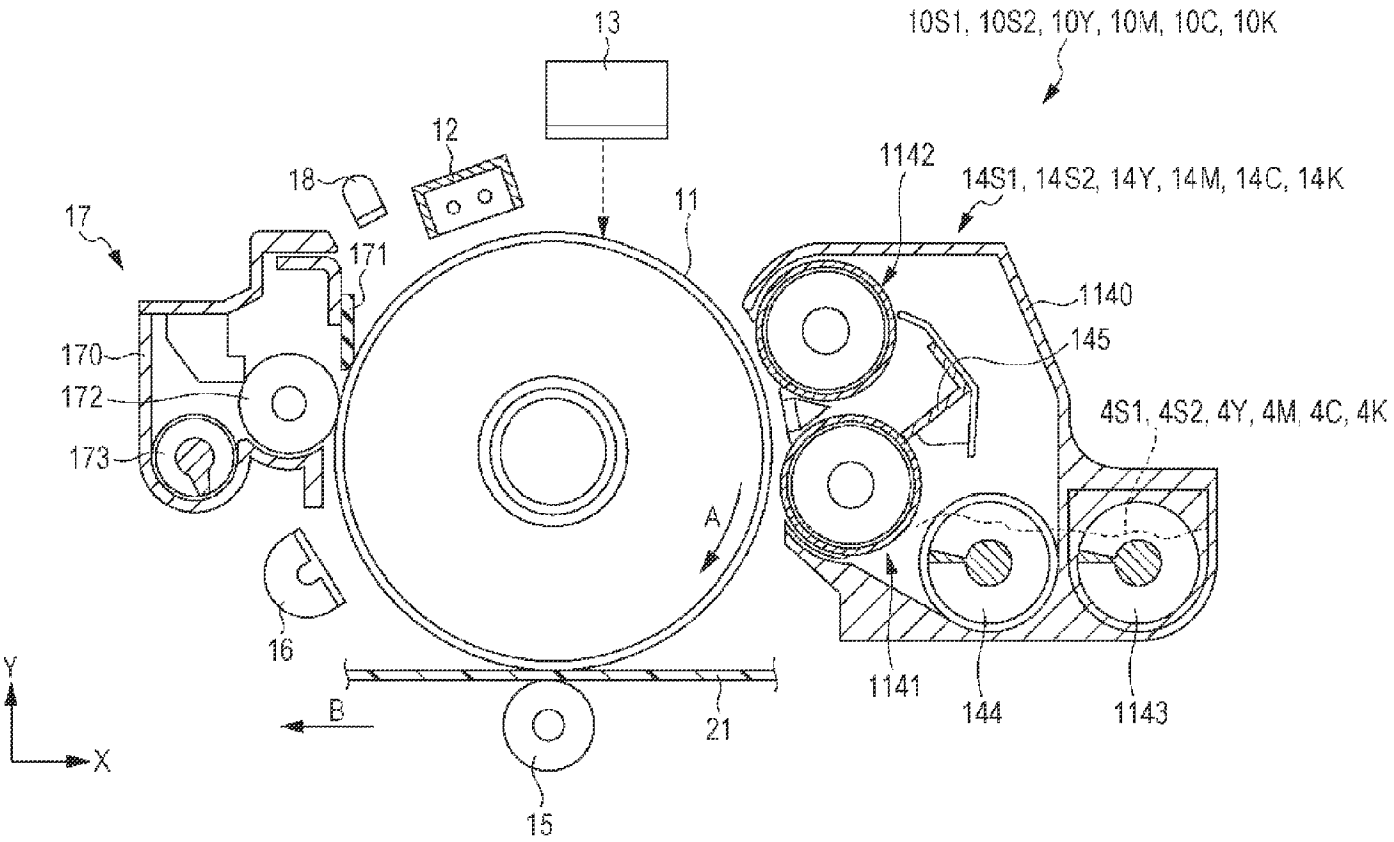
FIG. 2 is a partially sectioned view of a part, including an imaging device, of the image forming apparatus illustrated in FIG. 1.
Figure 3:
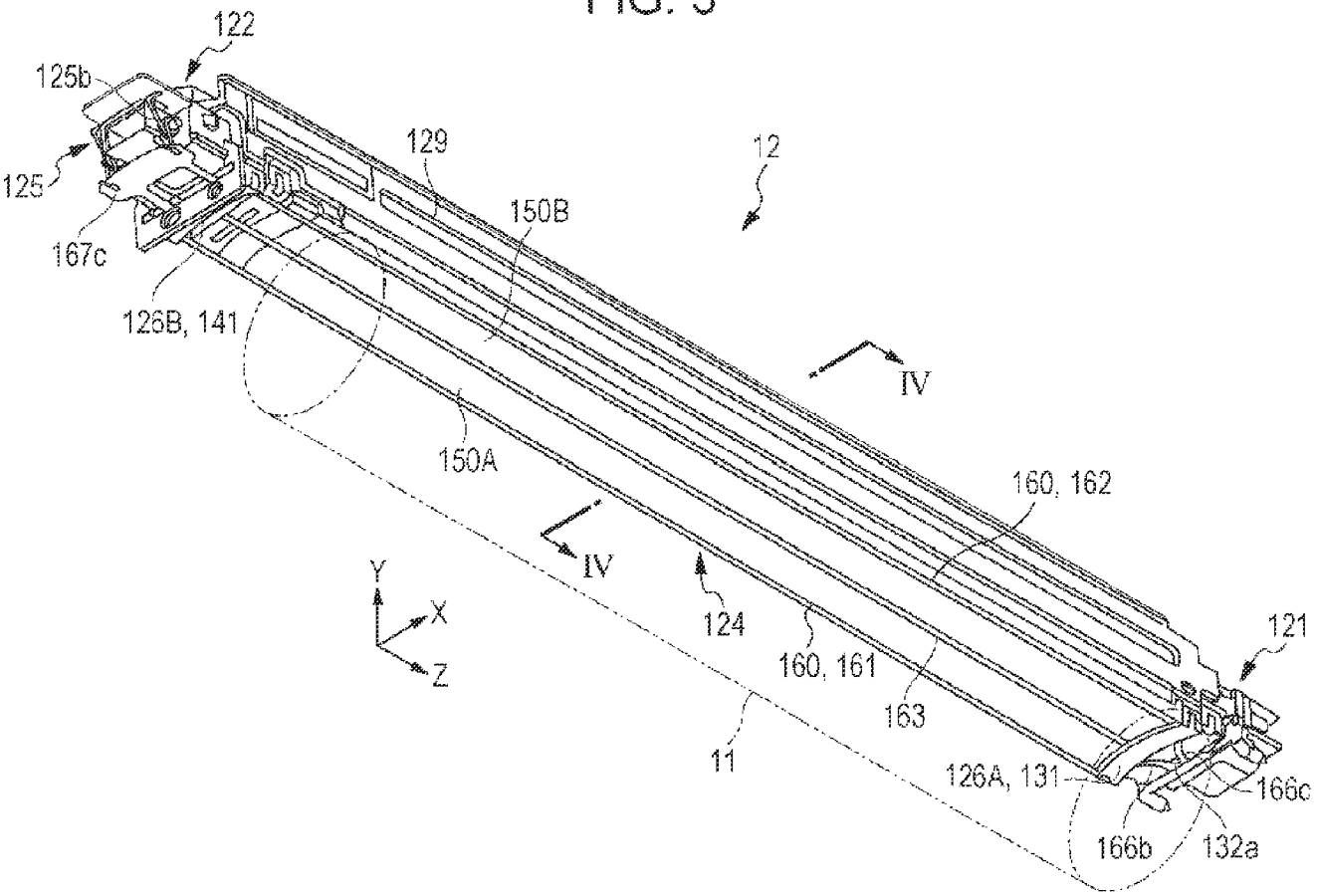
FIG. 3 is a perspective view of the charging device included in the image forming apparatus illustrated in FIG. 1 viewed from below.

FIGS. 1 and 2 illustrate an image forming apparatus 1 according to a first exemplary embodiment. FIG. 1 illustrates the overall structure of the image forming apparatus 1, and FIG. 2 illustrates an enlarged view of a part (for example, imaging devices) of the image forming apparatus 1.

Overall Structure of Image Forming Apparatus

The image forming apparatus 1 according to the first exemplary embodiment is, for example, a color printer. The image forming apparatus 1 includes plural imaging devices 10, an intermediate transfer device 20, a paper feeding device 50, and a fixing device 40. Each imaging device 10 forms a toner image developed with toner contained in developer 4. The intermediate transfer device 20 carries toner images formed by the respective imaging devices 10 and transports the toner images to a second transfer position at which the toner images are transferred onto a sheet of recording paper 5, which is an example of a recording medium, in a second transfer process. The paper feeding device 50 contains and transports the sheet of recording paper 5 to be supplied to the second transfer position of the intermediate transfer device 20. The fixing device 40 fixes the toner images that have been transferred onto the sheet of recording paper 5 by the intermediate transfer device 20 in the second transfer process.

In the case where, for example, an image input device 60 that inputs a document image to be formed on the sheet of recording paper 5 is additionally provided, the image forming apparatus 1 may be configured as a color copier. Referring to FIG. 1, the image forming apparatus 1 includes a housing 1*a* including, for example, a supporting structural member and an external covering part. The one-dot chain line shows a transport path along which the sheet of recording paper 5 is transported in the housing 1*a*.

Structure of Part of Image Forming Apparatus

The imaging devices 10 include six imaging devices 10Y, 10M, 10C, 10K, 10S1, and 10S2. The imaging devices 10Y, 10M, 10C, and 10K respectively form toner images of four colors, which are yellow (Y), magenta (M), cyan (C), and black (K). The imaging devices 10S1 and 10S2 respectively form two types of toner images of special colors S1 and S2. The six imaging devices 10 (S1, S2, Y, M, C, and K) are arranged along a line in the inner space of the housing 1*a*. The developers 4 (S1 and S2) of the special colors (S1 and S2) contain, for example, materials of colors which are difficult or impossible to be expressed by the above-described four colors. More specifically, toners of colors other than the four colors, toners having the same colors as the four colors but saturations different from those of the toners of four colors, clear toners that increase the glossiness, foaming toners used in Braille printing, fluorescent toners, etc., may be used. The imaging devices 10 (S1, S2, Y, M, C, and K) have a substantially similar structure, as described below, except for the type of the developer used therein.

As illustrated in FIGS. 1 and 2, each imaging device 10 (S1, S2, Y, M, C, or K) includes a photoconductor drum 11 that rotates, and devices described below are arranged around the photoconductor drum 11. The devices include a charging device 12, an exposure device 13, a developing device 14 (S1, S2, Y, M, C, K), a first transfer device 15, a pre-cleaning charging device 16, a drum cleaning device 17, and a electricity removing device 18. The charging device 12 charges a peripheral surface (image carrying surface) of the photoconductor drum 11, on which an image may be formed, to a certain potential. The exposure device 13 irradiates the charged peripheral surface of the photoconductor drum 11 with light LB based on image information (signal) to form an electrostatic latent image (for the corresponding color) having a potential difference. The developing device 14 (S1, S2, Y, M, C, or K) forms a toner image by developing the electrostatic latent image with toner contained in the developer 4 of the corresponding color (S1, S2, Y, M, C, or K). The first transfer device 15 performs a first transfer process in which the toner image is transferred onto the intermediate transfer device 20. The pre-cleaning charging device 16 charges substances, such as toner, that remain on the image carrying surface of the photoconductor drum 11 after the first transfer process. The drum cleaning device 17 cleans the image carrying surface by removing the recharged substances. The electricity removing device 18 removes electricity from the image carrying surface of the photoconductor drum 11 after the cleaning process.

The photoconductor drum 11 includes a cylindrical or columnar base member that is grounded and a photoconductive layer (photosensitive layer) that is provided on the peripheral surface of the base member. The photoconductive layer is made of a photosensitive material and is provided with the image carrying surface. The photoconductor drum 11 is supported so as to be capable of rotating in the direction shown by arrow A when power is transmitted thereto from a rotation driving device (not shown).

The charging device 12 is a non-contact charging device, such as a corona discharger, and is arranged without contacting the photoconductor drum 11. The charging device 12 includes a discharge member that receives a charging voltage. In the case where the developing device 14 performs reversal development, a voltage or current having the same polarity as the charging polarity of the toner supplied by the developing device 14 is supplied as the charging voltage.

The exposure device 13 forms the electrostatic latent image by irradiating the charged peripheral surface of the photoconductor drum 11 with light (arrowed dashed line) LB generated in accordance with the image information input to the image forming apparatus 1. When forming the electrostatic latent image, the exposure device 13 receives the image information (signal) that is input to the image forming apparatus 1 by any method.

As illustrated in FIG. 2, each developing device 14 (S1, S2, Y, M, C, or K) includes a housing 1140 having an opening and a chamber of the developer 4. Two developing rollers 1141 and 1142, two stirring-and-transporting members 1143 and 144, and a layer-thickness regulating member 145 are disposed in the housing 1140. The two developing rollers 1141 and 1142 hold the developer 4 and transport the developer 4 to respective developing areas in which the developing rollers 1141 and 1142 face the photoconductor drum 11. The stirring-and-transporting members 1143 and 144 are, for example, two screw augers that transport the developer 4 while stirring the developer 4 so that the developer 4 passes between the developing rollers 1141 and 1142. The layer-thickness regulating member 145 regulates the amount (layer thickness) of the developer 4 held by the developing roller 1142. A developing voltage supplied from a power supply device (not shown) is applied between the photoconductor drum 11 and the developing rollers 1141 and 1142 of the developing device 14. The developing rollers 1141 and 1142 and the stirring-and-transporting members 1143 and 144 receive power from a rotation driving device (not shown) and rotates in a certain direction. Two-component developers containing nonmagnetic toner and magnetic carrier are used as the developers 4 (Y, M, C, and K) of the above-described four colors and the developers 4 (S1 and S2) of the two special colors.

The first transfer device 15 is a contact transfer device including a first transfer roller which rotates while contacting the peripheral surface of the photoconductor drum 11 and receives a first transfer voltage. A direct-current voltage having a polarity opposite to the charging polarity of the toner is supplied as the first transfer voltage from the power supply device (not shown).

As illustrated in FIG. 2, the drum cleaning device 17 includes a container-shaped body 170 that has an opening, a cleaning plate 171, a rotating brush roller 172, and a transporting member 173. The cleaning plate 171 is arranged to contact the peripheral surface of the photoconductor drum 11 at a certain pressure after the first transfer process and clean the peripheral surface of the photoconductor drum 11 by removing substances such as residual toner therefrom. The rotating brush roller 172 is arranged to contact with the peripheral surface of the photoconductor drum 11 while rotating at a position upstream of the cleaning plate 171 in the rotation direction of the photoconductor drum 11. The transporting member 173 is, for example, a screw auger that transports the substances such as toner that have been removed by the cleaning plate 171 to a collecting system (not shown). The cleaning plate 171 may be formed of a plate-shaped member (for example, a blade) made of rubber or the like.

As illustrated in FIG. 1, the intermediate transfer device 20 is disposed below the imaging devices 10 (S1, S2, Y, M, C, and K). The intermediate transfer device 20 basically includes an intermediate transfer belt 21, plural belt support rollers 22 to 27, a second transfer device 30, and a belt cleaning device 28. The intermediate transfer belt 21 rotates in the direction shown by arrow B while passing through a first transfer position, which is between the photoconductor drum 11 and the first transfer device 15 (first transfer roller). The belt support rollers 22 to 27 retain the intermediate transfer belt 21 in a desired position at the inner surface of the intermediate transfer belt 21 so that the intermediate transfer belt 21 is rotatably supported. The second transfer device 30 is disposed to oppose the belt support roller 26 that supports the intermediate transfer belt 21 at the outer-peripheral-surface (image-carrying-surface) side of the intermediate transfer belt 21. The second transfer device 30 performs a second transfer process in which the toner images on the intermediate transfer belt 21 are transferred onto the sheet of recording paper 5. The belt cleaning device 28 cleans the outer peripheral surface of the intermediate transfer belt 21 by removing substances such as toner and paper dust that remain on the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjusting agent, such as carbon black, in a synthetic resin, such as polyimide resin or polyamide resin. The belt support roller 22 serves as a driving roller. The belt support rollers 23, 25, and 27 serve as driven rollers for retaining the position of the intermediate transfer belt 21. The belt support roller 24 serves as a tension-applying roller. The belt support roller 26 serves as a back-up roller in the second transfer process.

As illustrated in FIG. 1, the second transfer device 30 includes a second transfer belt 31 and plural support rollers 32 to 36. The second transfer belt 31 rotates in the direction shown by arrow C while passing through a second transfer position, which is on the outer-peripheral-surface side of the intermediate transfer belt 21 that is supported by the belt support roller 26 in the intermediate transfer device 20. The support rollers 32 to 36 retain the second transfer belt 31 in a desired position at the inner surface of the second transfer belt 31 so that the second transfer belt 31 is rotatably supported. The second transfer belt 31 is, for example, an endless belt having substantially the same structure as that of the above-described intermediate transfer belt 21. The belt support roller 32 is arranged so that the second transfer belt 31 is pressed at a certain pressure against the outer peripheral surface of the intermediate transfer belt 21 supported by the belt support roller 26. The belt support roller 32 serves as a driving roller, and the belt support roller 36 serves as a tension-applying roller. The belt support roller 32 of the second transfer device 30 or the belt support roller 26 of the intermediate transfer device 20 receives a direct-current voltage having a polarity that is opposite to or the same as the charging polarity of the toner as a second transfer voltage.

The fixing device 40 includes a heating rotating body 42 including a fixing belt and a pressing rotating body 43 that are arranged in a housing 41 having an inlet and an outlet for the sheet of recording paper 5. The heating rotating body 42 rotates in the direction shown by the arrow and is heated by a heater so that the surface temperature thereof is maintained at a predetermined temperature. The pressing rotating body 43 is drum-shaped and contacts the heating rotating body 42 at a certain pressure substantially along the axial direction of the heating rotating body 42, so that the pressing rotating body 43 is rotated. In the fixing device 40, the contact portion in which the heating rotating body 42 and the pressing rotating body 43 contact each other serves as a fixing process unit that performs a certain fixing process (heating and pressing).

The paper feeding device 50 is disposed below the intermediate transfer device 20 and the second transfer device 30. The paper feeding device 50 basically includes at least one paper container 51 that contains sheets of recording paper 5 of the desired size, type, etc., in a stacked manner and a transporting device 52 that feeds the sheets of recording paper 5 one at a time from the paper container 51. The paper container 51 is, for example, attached to the housing 1*a* such that the paper container 51 may be pulled out therefrom at the front side (side that faces the user during operation) of the housing 1*a*.

Plural pairs of paper transport rollers 53 to 57, which transport each of the sheets of recording paper 5 fed from the paper feeding device 50 to the second transfer position, and a paper transport path including transport guides (not shown) are provided between the paper feeding device 50 and the second transfer device 30. The pair of paper transport rollers 57 that are disposed immediately in front of the second transfer position on the paper transport path serve as, for example, registration rollers for adjusting the time at which each sheet of recording paper 5 is to be transported. A paper transport device 58, which may be belt-shaped, is provided between the second transfer device 30 and the fixing device 40. The paper transport device 58 transports the sheet of recording paper 5 that has been transported from the second transfer belt 31 of the second transfer device 30 after the second transfer process to the fixing device 40. A pair of paper discharge rollers 59 are disposed near a paper outlet formed in the housing 1*a*. The pair of paper discharge rollers 59 discharge the sheet of recording paper 5 that has been subjected to the fixing process and transported from the fixing device 40 to the outside of the housing 1*a*.

The image input device 60, which is provided when the image forming apparatus 1 is formed as a color copier, is an image reading device that reads an image of a document 6 having the image information to be printed. The image input device 60 is arranged, for example, above the housing 1*a* as illustrated in FIG. 1. The image input device 60 basically includes a document receiving plate (platen glass) 61, a light source 62, a reflection mirror 63, a first reflection mirror 64, a second reflection mirror 65, an image reading element 66, and an imaging lens 67. The document receiving plate 61 includes, for example, a transparent glass plate on which the document 6 having the image information to be read is placed. The light source 62 irradiates the document 6 placed on the document receiving plate 61 while moving. The reflection mirror 63 receives reflected light from the document 6 and reflects the light in a predetermined direction while moving together with the light source 62. The first and second reflection mirrors 64 and 65 move at a predetermined speed by a predetermined distance with respect to the reflection mirror 63. The image reading element 66 includes, for example, a charge coupled device (CCD) that receives and reads the reflected light from the document 6 and converts the reflected light into an electrical signal. The imaging lens 67 focuses the reflected light on the image reading element 66. Referring to FIG. 1, the document receiving plate 61 is covered by an opening-closing covering part 68.

The image information of the document 6 that has been read by the image input device 60 is input to an image processing device 70, which subjects the image information to necessary image processing. The image input device 60 transmits the read image information of the document 6 to the image processing device 70 as, for example, red (R), green (G), and blue (B) three-color image data (for example, 8-bit data for each color). The image processing device 70 subjects the image data transmitted from the image input device 60 to predetermined image processing, such as shading correction, misregistration correction, brightness/color space conversion, gamma correction, frame erasing, and color/movement edition. The image processing device 70 converts the image signals obtained as a result of the image processing into image signals of the above-described four colors (Y, M, C, and K), and transmits the image signals to the exposure device 13. The image processing device 70 also generates image signals for the two special colors (S1 and S2).

Operation of Image Forming Apparatus

A basic image forming operation performed by the image forming apparatus 1 will now be described.

First, an image forming operation for forming a full-color image by combining toner images of four colors (Y, M, C, and K) by using the four imaging devices 10 (Y, M, C, and K) will be described.

When the image forming apparatus 1 receives command information of a request for the image forming operation (printing), the four imaging devices 10 (Y, M, C, and K), the intermediate transfer device 20, the second transfer device 30, and the fixing device 40 are activated.

In each of the imaging devices 10 (Y, M, C, and K), first, the photoconductor drum 11 rotates in the direction shown by arrow A and the charging device 12 charges the surface of the photoconductor drum 11 to a certain potential with a certain polarity (negative polarity in the first exemplary embodiment). Subsequently, the exposure device 13 irradiates the charged surface of the photoconductor drum 11 with the light LB based on the image signal obtained by converting the image information input to the image forming apparatus 1 into a component of the corresponding color (Y, M, C, or K). As a result, an electrostatic latent image for the corresponding color having a certain potential difference is formed on the surface of the photoconductor drum 11.

After that, each of the developing devices 14 (Y, M, C, and K) supplies the toner of the corresponding color (Y, M, C, or K), charged with a certain polarity (negative polarity), from the developing rollers 1141 and 1142 to the electrostatic latent image of the corresponding color formed on the photoconductor drum 11. The toner electrostatically adheres to the electrostatic latent image, so that the electrostatic latent image is developed. As a result of the developing process, the electrostatic latent images for the respective colors formed on the photoconductor drums 11 are visualized as toner images of the four colors (Y, M, C, and K) developed with the toners of the respective colors.

When the toner images of the respective colors formed on the photoconductor drums 11 of the imaging devices 10 (Y, M, C, and K) reach the respective first transfer positions, the first transfer devices 15 perform the first transfer process so that the toner images of the respective colors are successively transferred, in a superimposed manner, onto the intermediate transfer belt 21 of the intermediate transfer device 20 that rotates in the direction of arrow B.

In each imaging device 10, after the first transfer process, the pre-cleaning charging device 16 recharges the substances, such as toner, that remain on the surface of the photoconductor drum 11 after the first transfer process. Subsequently, the drum cleaning device 17 cleans the surface of the photoconductor drum 11 by scraping off the recharged substances, and the electricity removing device 18 removes the electricity from the cleaned surface of the photoconductor drum 11. Thus, the imaging device 10 is set to a standby state for the next imaging operation.

In the intermediate transfer device 20, the intermediate transfer belt 21 rotates so as to transport the toner images that have been transferred onto the intermediate transfer belt 21 by the first transfer process to the second transfer position. The paper feeding device 50 feeds a sheet of recording paper 5 to the paper transport path in accordance with the imaging operation. In the paper transport path, the pair of paper transport rollers 57, which serve as registration rollers, transport the sheet of recording paper 5 to the second transfer position in accordance with the transfer timing.

At the second transfer position, the second transfer device 30 performs the second transfer process in which the toner images on the intermediate transfer belt 21 are simultaneously transferred onto the sheet of recording paper 5. In the intermediate transfer device 20 after the second transfer process, the belt cleaning device 28 cleans the surface of the intermediate transfer belt 21 by removing the substances, such as toner, that remain on the surface after the second transfer process.

The sheet of recording paper 5, onto which the toner images have been transferred by the second transfer process, is released from the intermediate transfer belt 21 and from the second transfer belt 31 and transported to the fixing device 40 by the paper transport device 58. In the fixing device 40, the sheet of recording paper 5 after the second transfer process is guided through the contact portion between the heating rotating body 42 and the pressing rotating body 43 that rotate. Thus, a fixing process (heating and pressing) is performed so that the unfixed toner images are fixed to the sheet of recording paper 5. In the case where the image forming operation is performed to form an image only on one side of the sheet of recording paper 5, the sheet of recording paper 5 that has been subjected to the fixing process is discharged to, for example, a discharge container (not illustrated) disposed outside the housing 1*a* by the paper discharge rollers 59.

As a result of the above-described operation, the sheet of recording paper 5 on which a full-color image is formed by combining toner images of four colors is output.

Next, the case will be described in which special-color toner images are additionally formed by using the developers of the special colors S1 and S2 in the above-described normal image forming operation performed by the image forming apparatus 1.

In this case, first, the imaging devices 1051 and 1052 perform an operation similar to the imaging operation performed by the imaging devices 10 (Y, M, C, and K). Accordingly, special-color toner images (S1 and S2) are formed on the photoconductor drums 11 of the imaging devices 1051 and 1052. Subsequently, similar to the manner in which the toner images of the four colors are processed in the above-described image forming operation, the special-color toner images formed by the imaging devices 1051 and 1052 are transferred onto the intermediate transfer belt 21 of the intermediate transfer device 20 in the first transfer process. Then, in the second transfer process, the second transfer device 30 transfers the special-color toner images from the intermediate transfer belt 21 onto the sheet of recording paper 5 together with the toner images of the other colors. Lastly, the sheet of recording paper 5, onto which the special-color toner images and the toner images of the other colors have been transferred in the second transfer process, is subjected to the fixing process performed by the fixing device 40 and discharged to the outside of the housing 1*a*.

As a result of the above-described operation, the sheet of recording paper 5 is output on which the two special-color toner images overlap with a part or the entirety of the full-color image formed by combining the toner images of four colors together.

In the case where the image forming apparatus 1 is equipped with the image input device 60 and serves as a color copier, a basic image forming operation is performed as follows.

That is, in this case, when the document 6 is set to the image input device 60 and command information of a request for the image forming operation (copying) is input, the image input device 60 reads the document image from the document 6. The information of the read document image is subjected to the above-described image processing performed by the image processing device 70, so that the image signals are generated. The image signals are transmitted to the exposure devices 13 of the imaging devices 10 (S1, S2, Y, M, C, and K). Accordingly, each imaging device 10 forms an electrostatic latent image and a toner image based on the image information of the document 6. After that, an operation similar to the above-described image forming operation (printing) is performed and the sheet of recording paper 5 on which an image obtained by combining the toner images together is formed is output.

Detailed Structure of Part of Image Forming Apparatus

A part (in particular, the charging device of each imaging device) of the image forming apparatus 1 will now be described.

Detailed Structure of Charging Device

First, the structure of the charging device 12 will be described in detail.

As illustrated in FIGS. 2 to 5, the charging device 12 is a so-called scorotron charging device including a shield case 120, two end supports 121 and 122, two corona discharge wires 123A and 123B, and a grid electrode 124. The shield case 120 extends along the axial direction of the photoconductor drum 11 (direction substantially along the coordinate axis Z). At least the bottom side of the shield case 120 that faces the photoconductor drum 11 is open. The end supports 121 and 122 are attached to the ends of the shield case 120 in the longitudinal direction. The corona discharge wires 123A and 123B are attached to the two end supports 121 and 122 so as to be stretched substantially linearly in the inner space of the shield case 120. The grid electrode 124 is a thin-plate-shaped or substantially thin-plate-shaped member that is attached to the bottom of the shield case 120 so as to cover the opening at the bottom side and be disposed between the outer peripheral surface of the photoconductor drum 11 and the corona discharge wires 123A and 123B.

Figure 4:
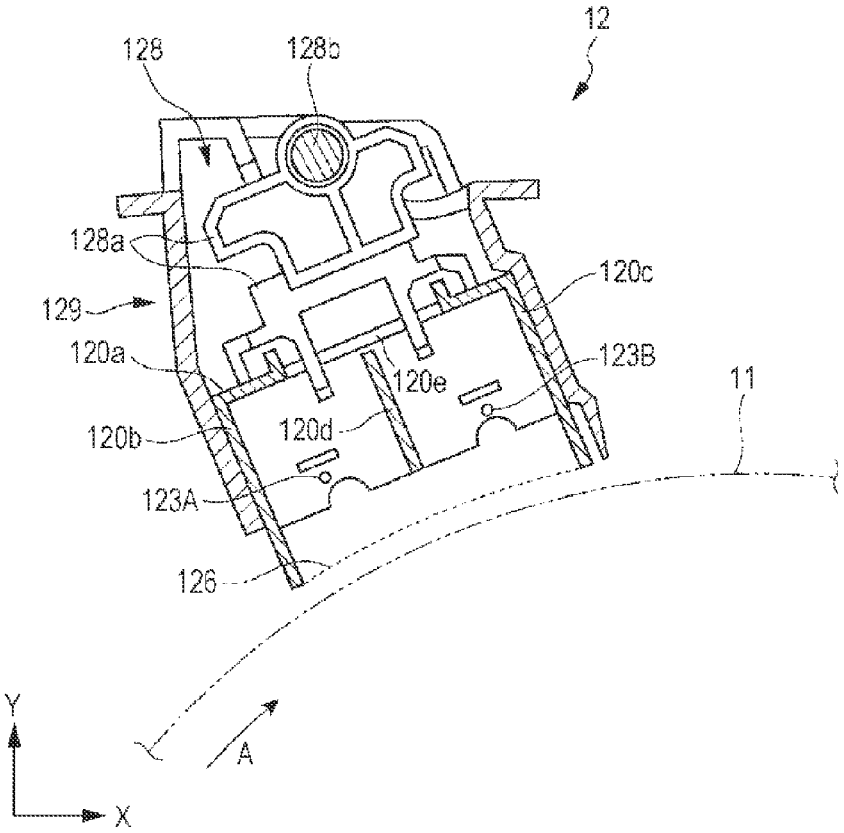
FIG. 4 is a sectional view of the charging device illustrated in FIG. 3 taken along line IV-IV.
Figure 5:
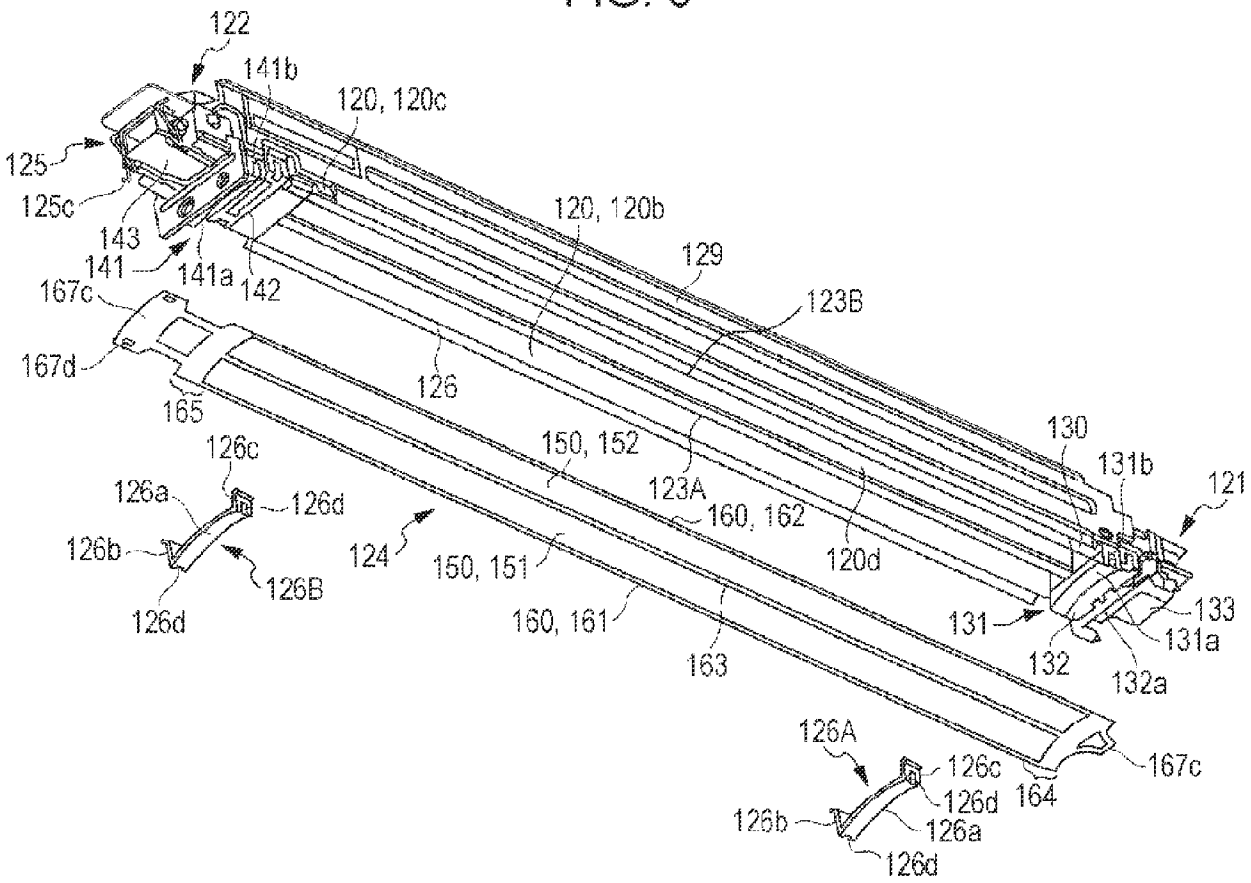
FIG. 5 is an exploded perspective view of the charging device illustrated in FIG. 3.

In FIGS. 4, 5, and other drawings, a cleaning device 128, which cleans the corona discharge wires 123A and 123B, includes a movable body 128*a* and a transmission shaft 128*b* used to reciprocate the movable body 128*a*. The component denoted by 129 functions as both a support member for supporting the transmission shaft 128*b* of the cleaning device 128 and an attachment assist member used when the shield case 120 (charging device 12) is attached to the imaging device 10.

The shield case 120 is arranged so as to face the outer peripheral surface of the photoconductor drum 11, which is an object to be charged, along the axial direction of the photoconductor drum 11, and is configured to prevent the corona discharge from affecting components other than the object to be charged. According to the first exemplary embodiment, the shield case 120 includes a substantially rectangular top plate 120*a* that extends in the axial direction of the photoconductor drum 11, two substantially rectangular side plates 120*b* and 120*c* that extend downward from the long sides of the top plate 120*a*, and a partition plate 120*d* that divides the inner space surrounded by the top plate 120*a* and the two side plates 120*b* and 120*c* into two spaces along the longitudinal direction. The bottom side of the shield case 120 that opposes the top plate 120*a* faces the outer peripheral surface of the photoconductor drum 11 along the axial direction, and a substantially rectangular opening (see FIGS. 4 and 5) is formed at the bottom side of the shield case 120. The top plate 120*a* of the shield case 120 has an opening 120*e* that extends in the longitudinal direction in a central area thereof (see FIG. 4). The shield case 120 is made of, for example, a metal, such as stainless steel or aluminum, a semiconductive resin obtained by mixing a conductive material, such as carbon black, with a synthetic resin, such as a polycarbonate, a nylon, or an acrylic resin, or a composite material obtained by coating the semiconductive resin with a surface layer made of tetrahedral amorphous carbon (ta-C) or the like.

The end supports 121 and 122 are attached to the shield case 120 by being fitted into inner spaces of respective end portions of the shield case 120. In this state, the corona discharge wires 123A and 123B and the grid electrode 124 are attached to and supported by the end supports 121 and 122. The end supports 121 and 122 are made of, for example, an electrically insulating material, such as stainless steel or aluminum.

Figure 6:
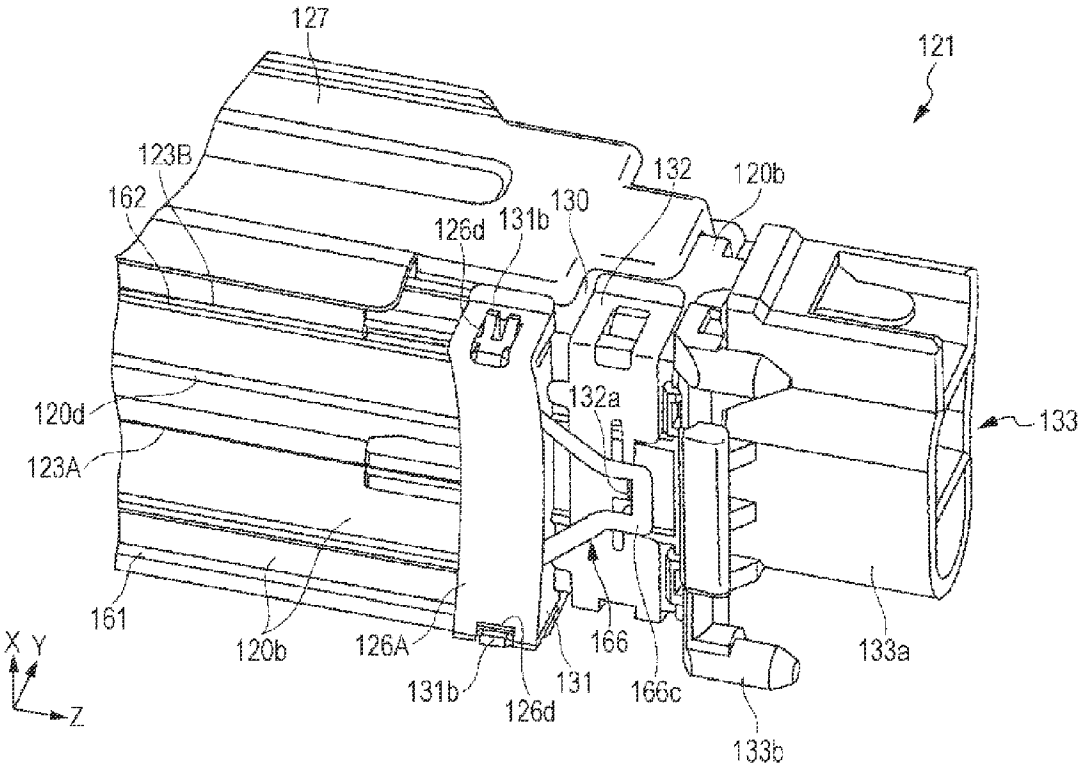
FIG. 6 is an enlarged perspective view of one end portion of the charging device illustrated in FIG. 3.

The end support 121 is attached to, for example, a first end portion of the shield case 120, and is referred to as a first end support herein. As illustrated in, for example, FIGS. 5 and 6, the first end support 121 includes a support body 130 to which each of the two corona discharge wires 123A and 123B is attached at a first end thereof.

The first end support 121 includes a curve-regulating portion 131 provided on the support body 130 at a location (bottom side) that corresponds to the opening at the bottom side of the shield case 120. A first end portion of the grid electrode 124 is restrained in a curved state by being brought into contact with the curve-regulating portion 131. A power supply fitting 132 is attached to the support body 130. The first end portion of the grid electrode 124 is brought into contact with the power supply fitting 132 so that electricity is supplied thereto. The curve-regulating portion 131 has a curve reference surface 131*a* having a shape that corresponds to a curved surface shape (shape of a curved surface having a predetermined curvature) of the outer peripheral portion of the photoconductor drum 11 that is to be charged. The power supply fitting 132 includes a projection 132*a* onto which a support portion, which will be described below, is hooked, the support portion being provided on the first end portion of the grid electrode 124. The projection 132*a* is formed by, for example, bending a part of the power supply fitting 132.

The first end support 121 further includes an attachment portion 133 that functions as an end cover. The attachment portion 133 is provided on the support body 130 at the end opposite the first end portion of the shield case 120. The attachment portion 133 has a contact support surface 133*a* which comes into contact with a free end of a support spring, which will be described below, when the charging device 12 is attached to a charging-device receiving section provided in, for example, the image forming apparatus 1 (imaging device 10). Referring to, for example, FIG. 6, attachment portions 133*b* are inserted into receiving portions formed in a support member (drum support frame) that supports the photoconductor drum 11 in a rotatable manner, so that a first end portion of the charging device 12 (shield case 120) is attached to the support member.

Figure 7:
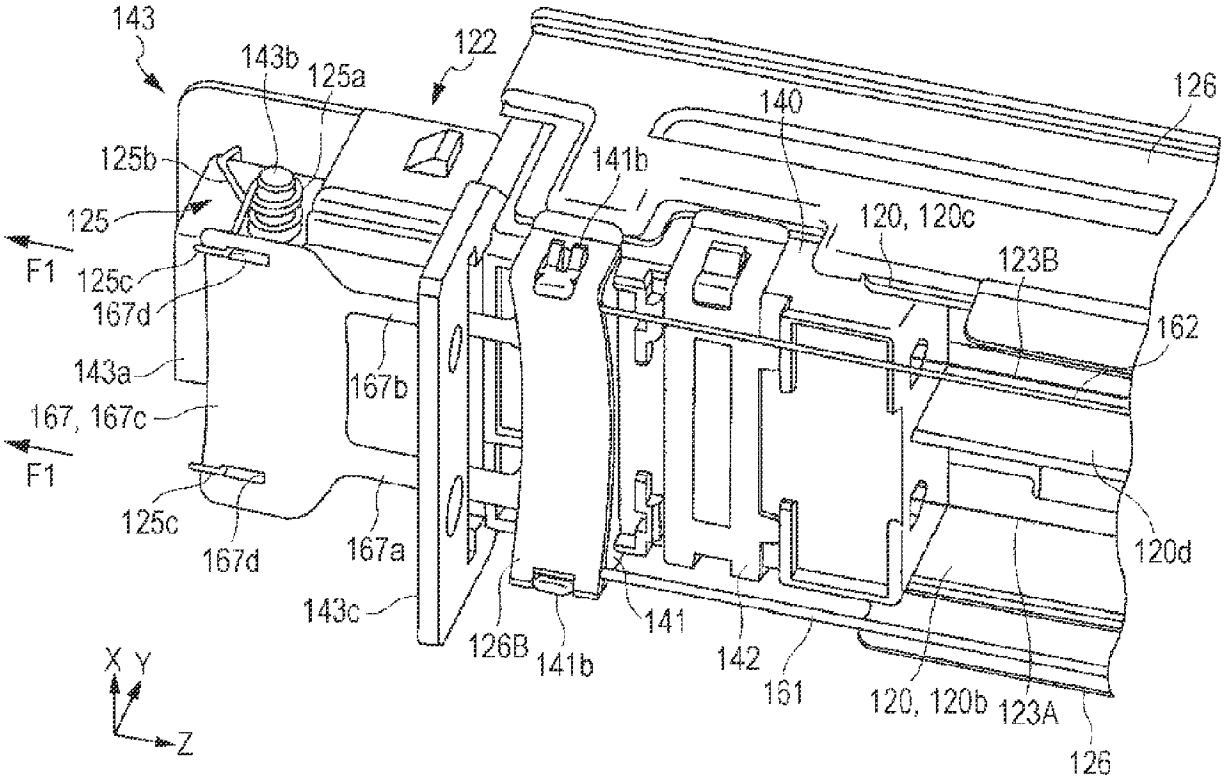
FIG. 7 is an enlarged perspective view of the other end portion of the charging device illustrated in FIG. 3.

The end support 122 is attached to, for example, a second end portion of the shield case 120, and is referred to as a second end support herein. As illustrated in, for example, FIGS. 5 and 7, the second end support 122 includes a support body 140 to which each of the two corona discharge wires 123A and 123B is attached at a second end thereof.

The second end support 122 includes a curve-regulating portion 141 provided on the support body 140 at a location (bottom side) that corresponds to the opening at the bottom side of the shield case 120. A second end portion of the grid electrode 124 is restrained in a curved state by being brought into contact with the curve-regulating portion 141. A support member 142 is attached to the support body 140 at a location corresponding to the second end portion of the grid electrode 124. The curve-regulating portion 141 has a curve reference surface 141*a* which, similar to the curve reference surface 131*a* of the first end support 121, has a shape that corresponds to the curved surface shape of the outer peripheral portion of the photoconductor drum 11 that is to be charged.

The second end support 122 further includes an attachment portion 143 that is provided on the support body 140 at the end opposite the second end portion of the shield case 120. Similar to the attachment portion 133 of the first end support 121, the attachment portion 143 has a contact support surface 143*a* which comes into contact with a free end of a support spring, which will be described below. Referring to, for example, FIG. 7, an attachment portion 143*c* is engaged with an attachment portion (projection) provided on the support member (drum support frame) that supports the photoconductor drum 11 in a rotatable manner, so that a second end portion of the charging device 12 (shield case 120) is attached to the support member.

The second end support 122 further includes tension-applying springs 125 that are provided on the attachment portion 143. The tension-applying springs 125 apply a tension (F) to the second end portion of the grid electrode 124 in the axial direction of the photoconductor drum 11, which is the same as the direction in which the corona discharge wires 123A and 123B are stretched and the longitudinal direction of the shield case 120.

The tension-applying springs 125 are, for example, helical springs including a pair of coil portions 125*a*. The pair of coil portions 125*a* of the tension-applying springs 125, which are helical springs, are fitted to respective attachment portions 143*b* provided so as to project from both side surfaces of the attachment portion 143. A first free end portion 125*b*, which is one of end portions that symmetrically extend from each coil portion 125*a*, serves as a fixed end portion and is engaged with a part of the attachment portion 143. A second free end portion 125*c*, which is the other one of the end portions that symmetrically extend from each coil portion 125*a*, serves as an acting end portion and is attached to an attachment frame portion 167 (for example, a hook hole 167*d*, which will be described below) of the grid electrode 124. Thus, the tension-applying springs 125 are arranged so as to exert spring forces as the tension (F).

The second free end portion 125*c* of each tension-applying spring 125 is bent such that the distal end thereof extends outward. The height of the position at which the second free end portion 125*c* is in contact with the attachment frame portion 167 of the grid electrode 124 to apply the tension is set to be substantially equal to the height of a corresponding portion of the curve reference surface 141*a* of the curve-regulating portion 141 included in the second end support 122. The tension applied by the tension-applying springs 125 is set so that, for example, the spring constant is about 9.5 gf/mm.

As illustrated in, for example, FIGS. 3 and 5 to 7, the first and second end supports 121 and 122 are provided with curve-retaining members 126A and 126B, respectively. The retaining members 126A and 126B retain at least parts of both end portions of the grid electrode 124 in the longitudinal direction by pressing the parts against the curve reference surfaces 131*a* and 141*a* of the curve-regulating portions 131 and 141.

Each of the curve-retaining members 126A and 126B is a leaf spring that is substantially M-shaped in cross section and includes a pressing surface portion 126*a* and attachment surface portions 126*b* and 126*c*. The pressing surface portion 126*a* has a surface shape that corresponds to that of the curve reference surfaces 131*a* and 141*a*. The attachment surface portions 126*b* and 126*c* extend vertically from both ends of the pressing surface portion 126*a* and are shaped such that the attachment surface portions 126*b* and 126*c* may be fitted to side walls of the curve-regulating portions 131 and 141. Each of the curve-retaining members 126A and 126B has attachment holes 126*d* formed in the attachment surface portions 126*b* and 126*c* thereof. The side walls of the curve-regulating portions 131 and 141, which are used in combination with the curve-retaining members 126A and 126B, respectively, have attachment projections 131*b* and 141*b* provided thereon (see, for example, FIGS. 5 to 7). When the curve-retaining members 126A and 126B are attached to the side walls, the attachment projections 131*b* and 141*b* are fitted into the attachment holes 126*d*.

An end cover (not shown) that covers the attachment portion 143, the tension-applying springs 125, and the second end portion of the grid electrode 124 is attached to the second end support 122.

The corona discharge wires 123A and 123B are capable of generating corona discharge for charging the outer peripheral surface (image forming area) of the photoconductor drum 11, which is the object to be charged, to a desired polarity. The corona discharge wires 123A and 123B may be, for example, metal wires that are made of tungsten or the like and that have an outer diameter of 30 to 60 μm in cross section.

The corona discharge wires 123A and 123B are fixed to the support bodies 130 and 140 of the end supports 121 and 122 at the ends thereof so that a predetermined tension is applied thereto. The entire bodies of the corona discharge wires 123A and 123B extend substantially linearly along the axial direction of the photoconductor drum 11 in the inner space of the shield case 120. Connection terminals (not shown) provided on the support body 130 of the first end support 121, for example, are electrically connected to power supply terminals of a charging power supply device (not shown) when the charging device 12 is attached to the image forming apparatus 1. Accordingly a charging voltage is supplied to the corona discharge wires 123A and 123B.

As illustrated in, for example, FIGS. 5 and 8 to 10, the grid electrode 124 is a plate-shaped member including an opening section 150 in which plural openings 151 are arranged in a certain pattern and a frame section 160 arranged so as to surround the opening section 150. The grid electrode 124 according to the present exemplary embodiment is a long rectangular plate-shaped member that extends in the axial direction of the photoconductor drum 11.

Figure 9:
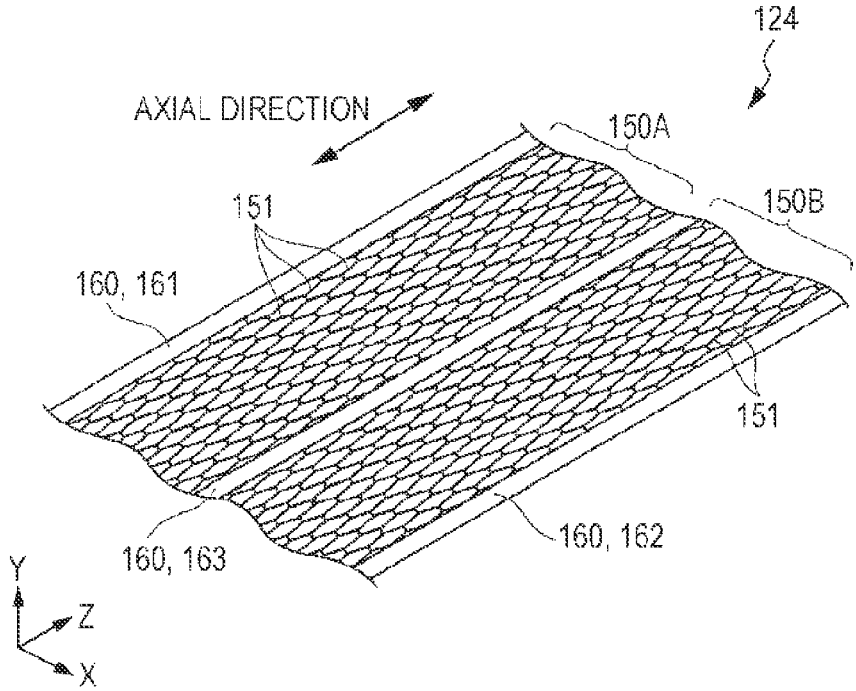
FIG. 9 is a perspective view of a part of the grid electrode illustrated in FIG. 8.

As illustrated in, for example, FIG. 9, the openings 151 in the opening section 150 have a hexagonal shape (basic shape) obtained by stretching a regular hexagon in a certain direction so that four long sides that oppose each other become longer than the remaining two sides. The openings 151 are arranged in a mesh pattern, that is, such that the openings 151 are regularly disposed next to each other so as to obliquely cross the axial direction of the photoconductor drum 11. The opening section 150 includes an area having a substantially rectangular shape that corresponds to the shape of the opening at the bottom side of the shield case 120 and that extends in the axial direction of the photoconductor drum 11. In the present exemplary embodiment, the opening section 150 is divided into two long rectangular opening portions 150A and 150B that extend in the axial direction of the photoconductor drum 11 by a part of the frame section 160.

The frame section 160 includes two linear long-side outer frame portions 161 and 162, two short-side outer frame portions 164 and 165, and attachment frame portions 166 and 167. The long-side outer frame portions 161 and 162 extend along the outer sides of the opening section 150 in the long-side direction (axial direction of the photoconductor drum 11). The short-side outer frame portions 164 and 165 extend along the outer sides of the end portions of the opening section 150 in the long-side direction and have a predetermined width in the short-side direction of the opening section 150 (direction along the coordinate axis X or the rotation direction of the photoconductor drum 11). The attachment frame portions 166 and 167 are respectively provided outside the short-side outer frame portions 164 and 165 (outside the opening section 150 in the long-side direction) and are used to attach the grid electrode 124 to the charging device 12.

In the first exemplary embodiment, the frame section 160 includes a central frame portion 163 at the midpoint between the two long-side outer frame portions 161 and 162 to ensure sufficient strength against the tension applied to the grid electrode 124 in the attached state. The short-side outer frame portions 164 and 165 are shaped (rectangular shaped) so as to have substantially the same area as the area of the curve reference surfaces 131*a* and 141*a* of the curve-regulating portions 131 and 141 of the end supports 121 and 122, respectively, and are positioned so that the short-side outer frame portions 164 and 165 come into contact with the curve reference surfaces 131*a* and 141*a*, respectively, when the grid electrode 124 is attached to the charging device 12. The central frame portion 163 may be omitted when sufficient strength against the tension is ensured.

Figure 8:
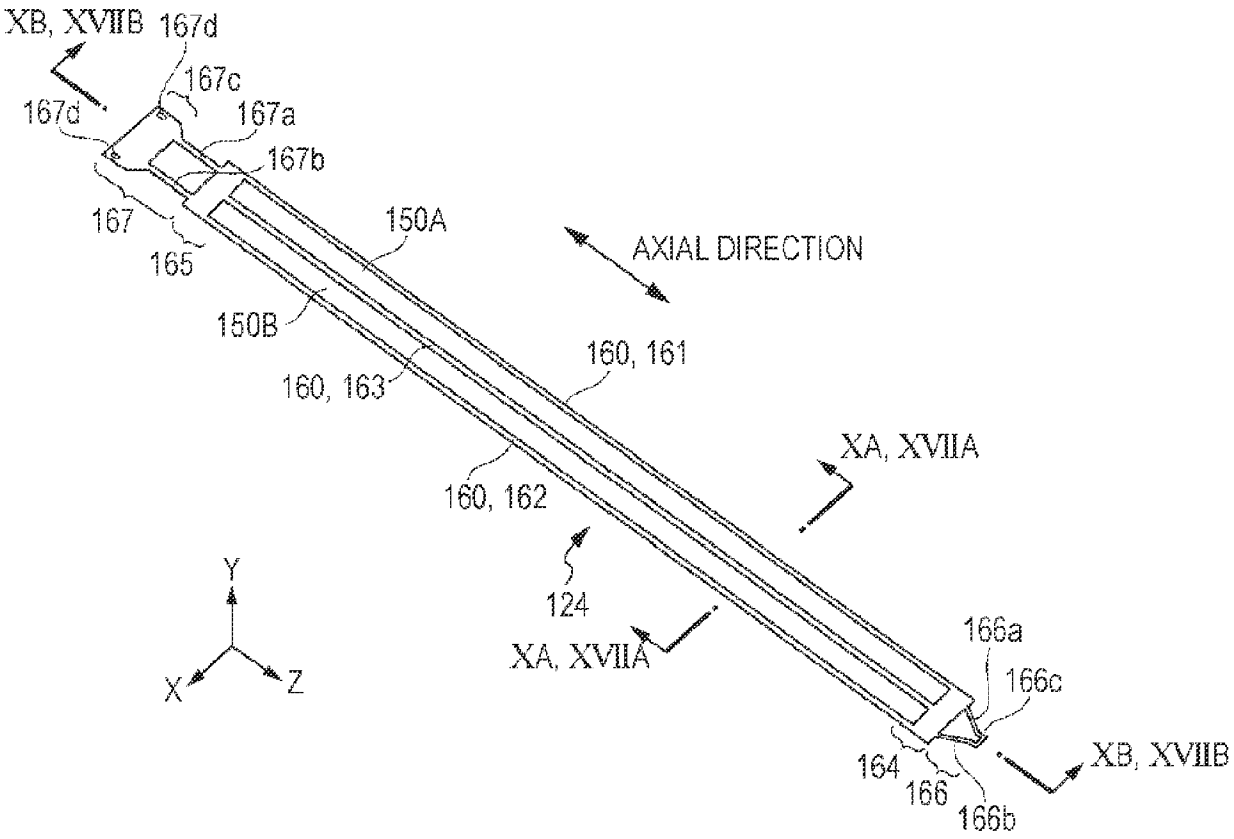
FIG. 8 is a perspective view of a grid electrode illustrated in FIG. 3.

As illustrated in, for example, FIG. 8, the first attachment frame portion 166 disposed outside the first short-side outer frame portion 164, which comes into contact with the curve reference surface 131*a* of the first end support 121, includes two oblique arm portions 166*a* and 166*b* and a hook portion 166*c*. The arm portions 166*a* and 166*b* symmetrically extend at an angle from positions near both ends of the outer side of the first short-side outer frame portion 164 in the short-side direction of the opening section 150 toward a central area in the short-side direction. The hook portion 166*c* is provided at the central area in which the arm portions 166*a* and 166*b* are bonded together, and is shaped such that the hook portion 166*c* may be hooked onto an object. The hook portion 166*c* is shaped so as to be capable of being hooked onto the above-described projection 132*a* on the power supply fitting 132 of the first end support 121.

As illustrated in, for example, FIG. 8, the second attachment frame portion 167 disposed outside the second short-side outer frame portion 165, which comes into contact with the curve reference surface 141*a* of the second end support 122, includes parallel arm portions 167*a* and 167*b* and a pulling portion 167*c*. The arm portions 167*a* and 167*b* extend parallel to each other in the long-side direction of the opening section 150 from positions near both ends of the outer side of the second short-side outer frame portion 165 in the short-side direction of the opening section 150. The pulling portion 167*c* is connected to the distal ends of the arm portions 167*a* and 167*b*. The pulling portion 167*c* is an end portion having a rectangular shape that is substantially the same as the shape of the second short-side outer frame portion 165. The hook holes 167*d*, to which the second free end portions 125*c* of the tension-applying springs 125 are hooked, are formed in the pulling portion 167*c* at positions near both ends thereof in the short-side direction of the opening section 150.

To reliably arrange the grid electrode 124 (the opening section 150 in practice) in a curved state so as to follow the curved shape of the outer peripheral surface of the photoconductor drum 11 along the axial direction of the photoconductor drum 11, one or both of the opening section 150 and the frame section 160 are formed such that parts thereof are thicker than the remaining parts. In contrast, grid electrodes (1240A to 1240C) according to the related art, which will be described below, have a constant thickness over the entire area thereof (see FIGS. 25A, 25B, 27A, and 27A).

Figure 10A:
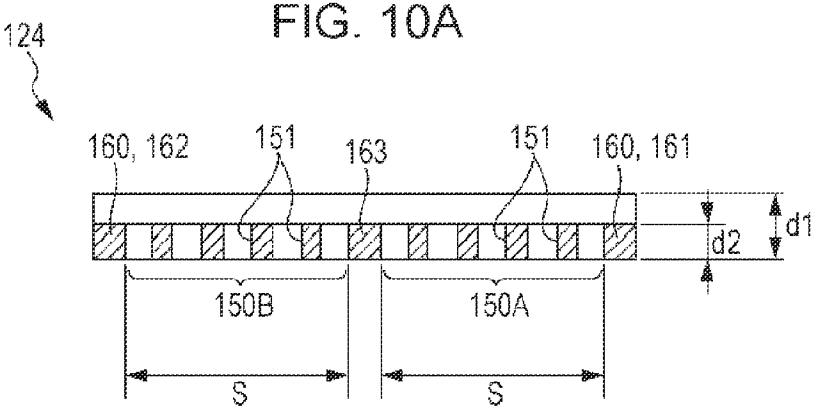
FIGS. 10A and 10B are sectional views of the grid electrode illustrated in FIG. 8 taken along lines XA-XA and XB-XB, respectively.
Figure 10B:
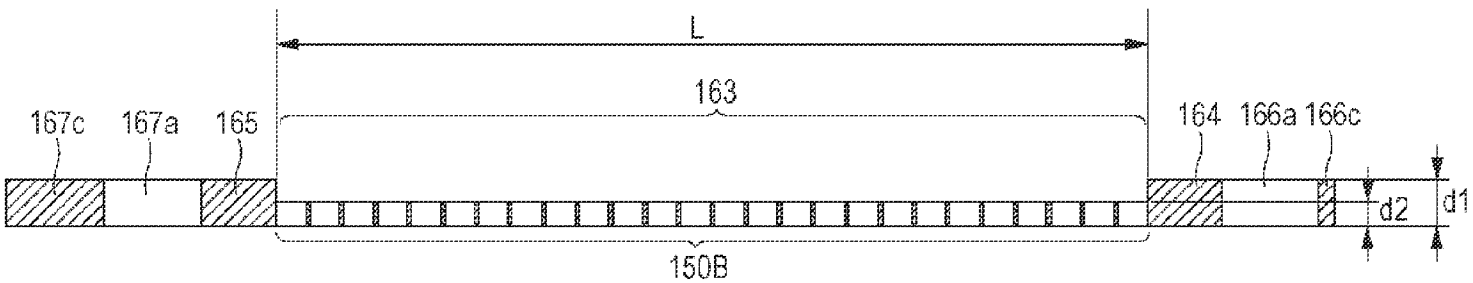

As schematically illustrated in FIGS. 10A and 10B, in the grid electrode 124 according to the first exemplary embodiment, the thickness d1 of the short-side outer frame portions 164 and 165 and the attachment frame portions 166 and 167 of the frame section 160 is set so as to be greater than the thickness d2 of the long-side outer frame portions 161 and 162 and the central frame portion 163 of the frame section 160 and the entire area of the opening section 150 (d1>d2). Thus, the short-side outer frame portions 164 and 165 and the attachment frame portions 166 and 167 of the frame section 160 are configured as "relatively thick portions". In this case, portions other than the thick portions, that is, the long-side outer frame portions 161 and 162 and the central frame portion 163 of the frame section 160 and the entire area of the opening section 150, are defined as "relatively thin portions". The grid electrode 124 is required to be arranged in a curved state so that the surface shape thereof corresponds to the shape of the outer peripheral surface of the photoconductor drum 11 (shape of the peripheral surface of a cylindrical or columnar body having a certain radius). Therefore, the thickness of the thick portions is set so that the grid electrode 124 may be elastically deformed into such a shape. Specifically, the thickness of the thick portion is set to, for example, 1.5 to 5 times greater than the thickness of the relatively thin portions.

The plate-shaped grid electrode 124 including portions having different thicknesses is formed by, for example, etching a plate-shaped electrode material made of a metal or the like. The grid electrode 124 is plate-shaped when the grid electrode 124 is not attached to the end supports 121 and 122 of the charging device 12.

The grid electrode 124 is attached to the charging device 12 at a predetermined position as follows.

Figure 11:
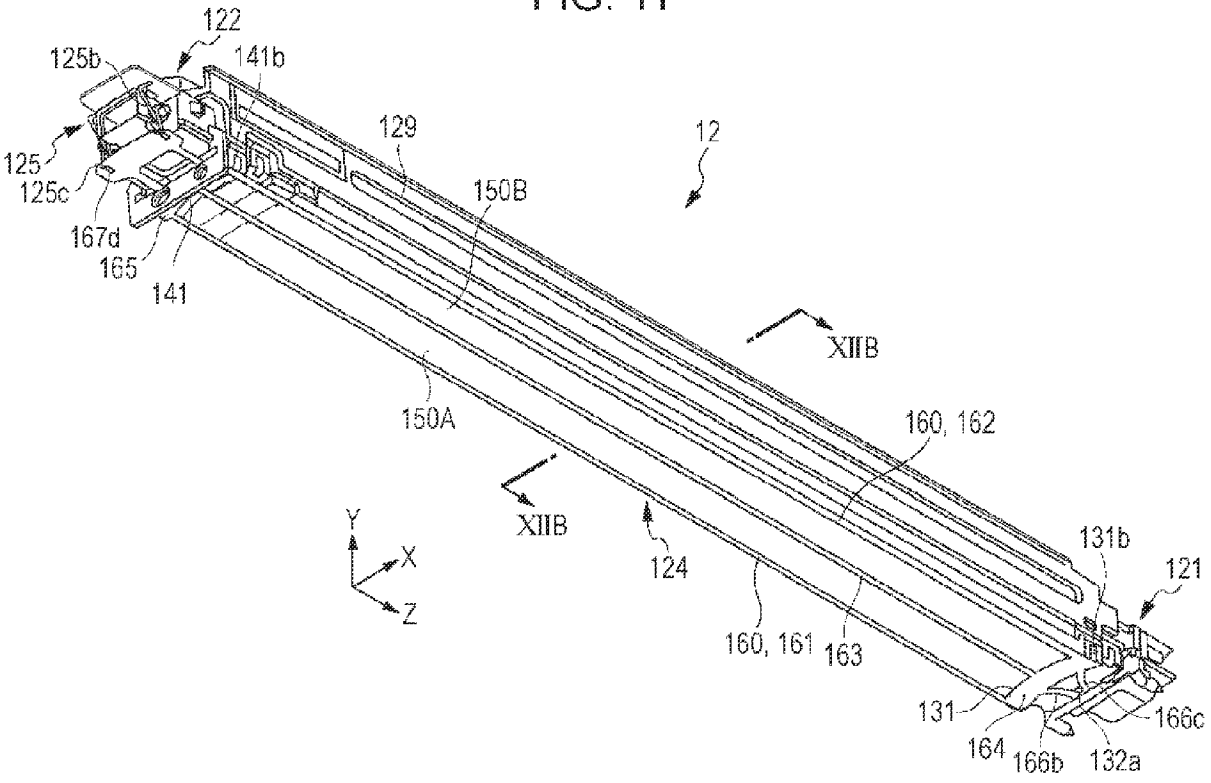
FIG. 11 is a perspective view illustrating the state in which the grid electrode is attached to the charging device and curve-retaining members are not attached to the grid electrode.
Figure 12A:
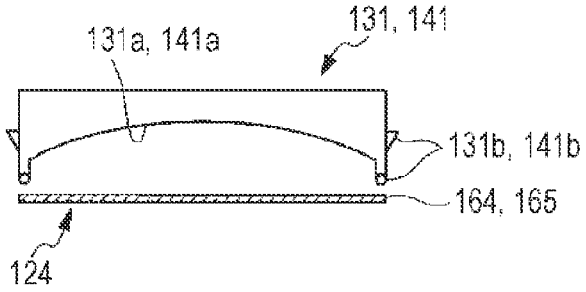
FIGS. 12A to 12C illustrate a process of attaching the grid electrode to the charging device, where

That is, as illustrated in, for example, FIGS. 11 and 12A, first, the grid electrode 124 is held such that the short-side outer frame portions 164 and 165 respectively face the curve reference surfaces 131*a* and 141*a* of the curve-regulating portions 131 and 141 of the two end supports 121 and 122 attached to both end portions of the shield case 120 in the longitudinal direction thereof. In this state, the entire body of the grid electrode 124 is substantially plate-shaped (see FIG. 12A).

Subsequently, as illustrated in, for example, FIG. 11, the grid electrode 124 is set to a state in which the hook portion 166*c* of the attachment frame portion 166 that is arranged near the first end support 121 is hooked onto the projection 132*a* on the power supply fitting 132 of the first end support 121 and the free end portions 125*c* of the tension-applying springs 125 are engaged with the hook holes 167*d* in the attachment frame portion 167 that is arranged near the second end support 122.

Thus, as illustrated in, for example, FIGS. 11 and 12A, the attachment frame portion 166 at one end of the grid electrode 124 is hooked onto the projection 132*a* on the power supply fitting 132, which is fixed to the first end support 121. The attachment frame portion 167 at the other end of the grid electrode 124 receives a tension F1 in the axial direction of the photoconductor drum 11 from the tension-applying springs 125, which are fixed to the second end support 122, and is pulled away from the end at which the attachment frame portion 166 is provided.

The tension F1 applied by the tension-applying springs 125 is applied to the pulling portion 167*c* with the two hook holes 167*d* in the attachment frame portion 167 acting as the points of action, and is transmitted to the short-side outer frame portion 165 through the two parallel arm portions 167*a* and 167*b*. Then, the tension F1 is transmitted from the short-side outer frame portion 165 to the opening portions 150A and 150B and the short-side outer frame portion 164 through the two long-side outer frame portions 161 and 162 and the central frame portion 163 that are parallel to one another.

In the grid electrode 124, the short-side outer frame portions 164 and 165 and the attachment frame portions 166 and 167 of the frame section 160 are thicker than the remaining portions, which are the long-side outer frame portions 161 and 162, the central frame portion 163, and the opening section 150. Therefore, the strength (resistance against deformation) of the structural lines of the electrode in the short-side direction is lower than that of the structural lines in the longitudinal direction since the thickness of the portions having the structural lines in the short-side direction is relatively large. Accordingly, the tension F1 applied by the tension-applying springs 125 is substantially evenly distributed to the long-side outer frame portions 161 and 162, the central frame portion 163, and the opening portions 150A and 150B, which are relatively thin portions of the grid electrode 124.

Figure 12B:
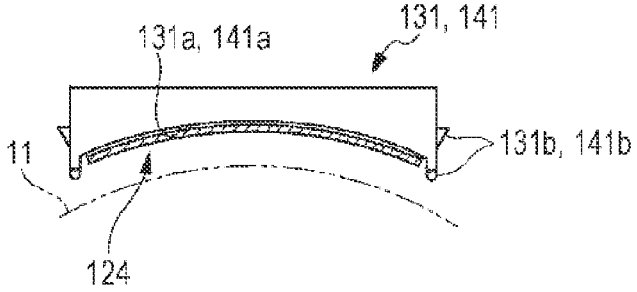

As a result, as illustrated in, for example, FIGS. 11 and 12B, when the grid electrode 124 receives the tension F1 of the tension-applying springs 125, the short-side outer frame portions 164 and 165 respectively come into contact with the curve reference surfaces 131*a* and 141*a* of the curve-regulating portions 131 and 141 of the end supports 121 and 122 and are deformed into the shape of the curve reference surfaces 131*a* and 141*a*. Therefore, the grid electrode 124 is prevented from being deformed such that a part of the opening section 150, which is disposed between the end supports 121 and 122, is curved at a curvature different from that of the other parts and deformed into, for example, a warped shape. Instead, the grid electrode 124 may be set to a state in which the grid electrode 124 is substantially uniformly curved into a surface shape that follows the shape of the curve reference surfaces 131*a* and 141*a*, that is, into a surface shape that substantially corresponds to the curved outer peripheral surface of the photoconductor drum 11, over the entire area thereof. The grid electrode 124 is in the curved state so as to substantially follow the curved outer peripheral surface of the photoconductor drum 11 in this stage, that is, before the curve-retaining members 126A and 126B are attached thereto.

Figure 12C:
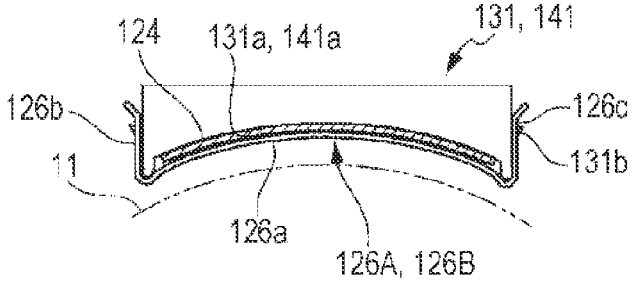
Figure 13:
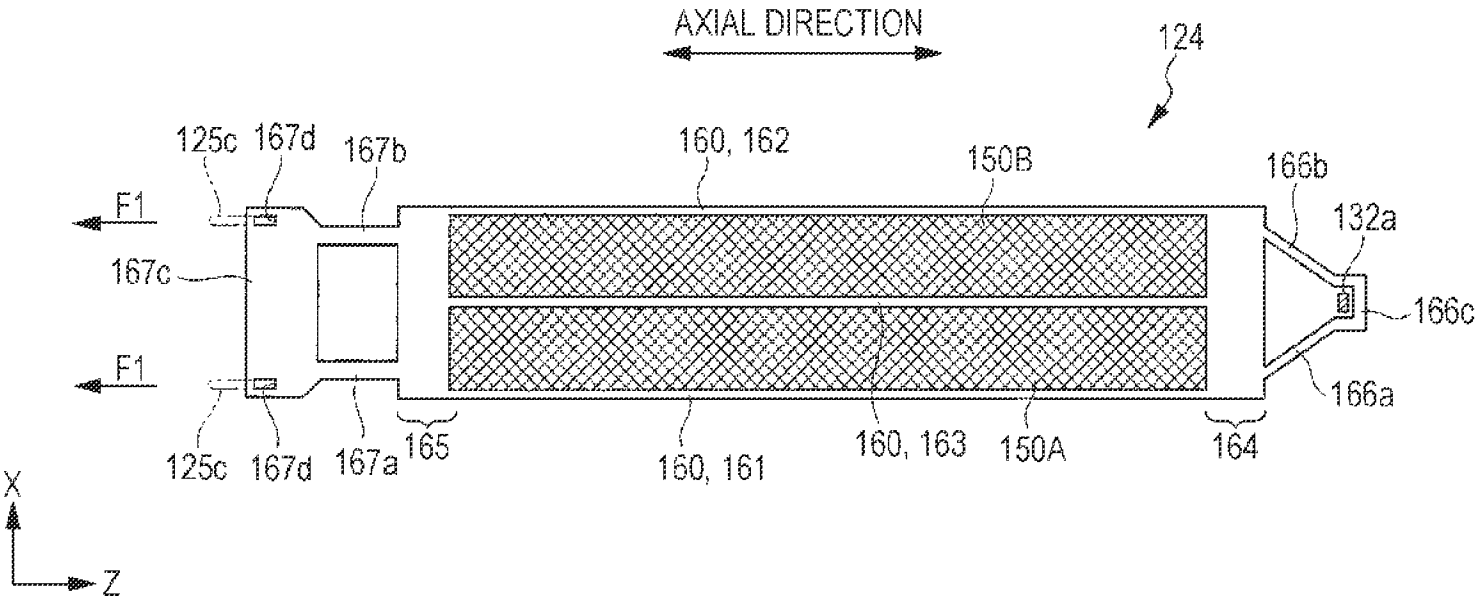
FIG. 13 illustrates the grid electrode in the state in which the grid electrode is attached to the charging device.

Then, as illustrated in FIG. 12C, the curve-retaining members 126A and 126B are respectively attached to the curve-regulating portions 131 and 141 of the end supports 121 and 122 with the short-side outer frame portions 164 and 165 of the grid electrode 124 interposed therebetween. Thus, as illustrated in, for example, FIG. 3, the grid electrode 124 is attached to the bottom of the shield case 120 of the charging device 12 so as to cover the opening at the bottom side. In this state, the attachment frame portion 166 is in contact with the power supply fitting 132 of the first end support 121, and end portions of the long-side outer frame portions 161 and 162 and the opening section 150 near the short-side outer frame portion 165 are in contact with the support member 142 of the second end support 122. Therefore, electricity may be supplied to the grid electrode 124.

In this state, the curve-retaining members 126A and 126B are secured by engaging the attachment holes 126*d* formed in the attachment surface portions 126*b* and 126*c* with the attachment projections 131*b* and 141*b* on the curve-regulating portions 131 and 141, respectively. Thus, the pressing surface portions 126*a* of the curve-retaining members 126A and 126B press the short-side outer frame portions 164 and 165 of the grid electrode 124 against the curve reference surfaces 131*a* and 141*a* of the curve-regulating portions 131 and 141, respectively.

When the tension F1 of the tension-applying springs 125 is applied to the grid electrode 124, the short-side outer frame portions 164 and 165 respectively come into contact with the curve reference surfaces 131*a* and 141*a* of the curve-regulating portions 131 and 141 of the end supports 121 and 122, and are deformed into the shape of the curve reference surfaces 131*a* and 141*a*. Therefore, the grid electrode 124 is set to a state in which the opening section 150, which is disposed between the end supports 121 and 122, is curved into a surface shape that follows the shape of the curve reference surfaces 131*a* and 141*a*, that is, into a surface shape that substantially corresponds to the curved outer peripheral surface of the photoconductor drum 11. Here, the curved state of the grid electrode 124 is also uniform along the axial direction of the photoconductor drum 11.

In the charging device 12 including the above-described grid electrode 124, the grid electrode 124 is appropriately curved over the entire area thereof as described above. Therefore, as illustrated in, for example, FIG. 15, the distances m1 and m2 from the grid electrode 124 in the curved state to the two corona discharge wires 123A and 123B may be set to a predetermined distance. The distances m1 and m2 are minimum distances from the opening section 150 of the grid electrode 124 to the corona discharge wires 123A and 123B.

Figure 14:
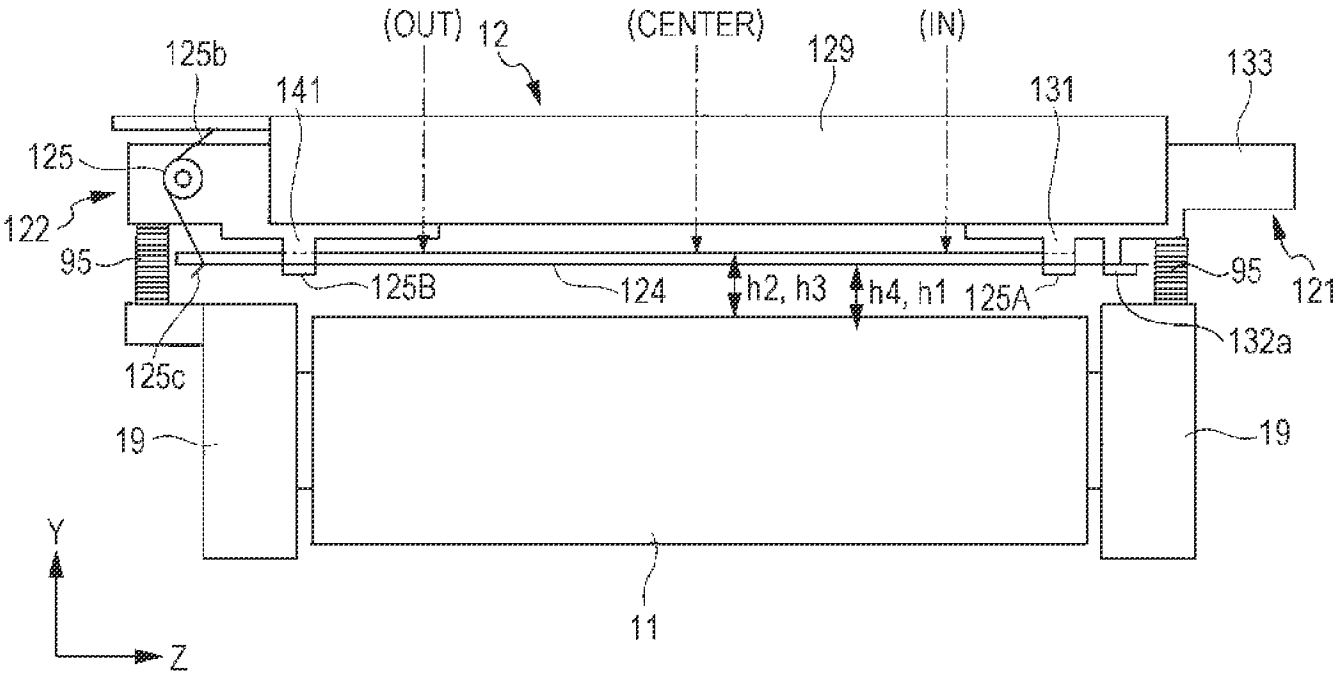
FIG. 14 is a schematic diagram illustrating the state in which the charging device illustrated in FIG. 3 is attached to a drum support frame.

As illustrated in FIG. 14, the charging device 12 is attached to charging-device receiving sections that are provided on drum support frames 19 that support the photoconductor drum 11 in a rotatable manner.

In this case, springs 95 that elastically press the charging device 12 in a direction away from the photoconductor drum 11 are attached to the charging-device receiving sections of the drum support frames 19. When the charging device 12 is attached to the charging-device receiving sections of the drum support frames 19, free ends of the springs 95 come into contact with the contact support surfaces 133*a* and 143*a* of the attachment portions 133 and 143 of the end supports 121 and 122, respectively. In the attachment process, the charging device 12 is pushed against the spring force (pressing force) of the springs 95, and the attachment position of the charging device 12 is determined when attachment projections (not shown) and attachment holes (not shown) provided on the charging device 12 and the drum support frames 19 are engaged with each other. In this state, the charging device 12 is continuously pressed in the direction away from the photoconductor drum 11 by the pressing force applied by the springs 95, and no clearances are left between the attachment projections and the attachment holes in the engaged state (no looseness or rattling occurs). As a result, the charging device 12 is appropriately secured in a state such that the charging device 12 is spaced from the photoconductor drum 11 by a predetermined distance. The predetermined distance is a minimum distance between the grid electrode 124 of the charging device 12 and the photoconductor drum 11, and is set in the range of, for example, 0.8 to 1.2 mm.

Figure 15:
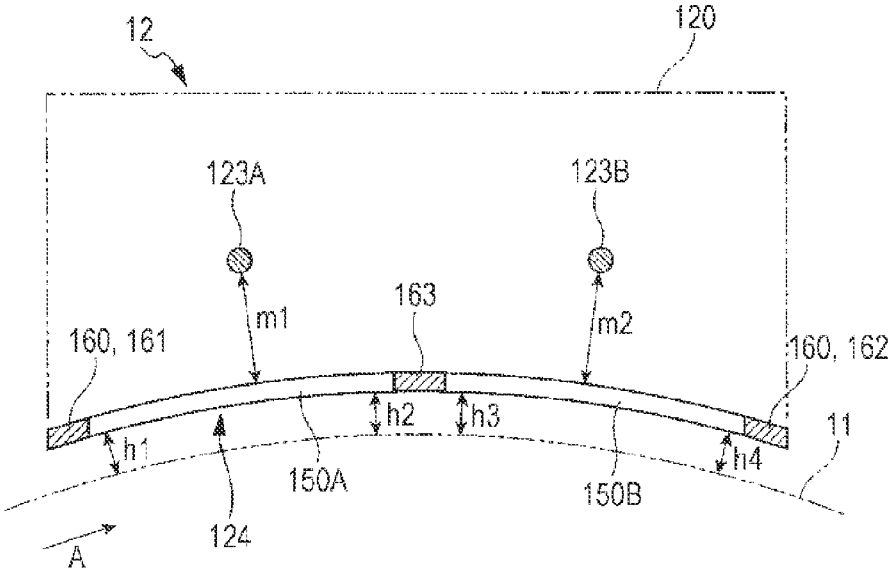
FIG. 15 illustrates the charging device shown in FIG. 3 in the attached state and distances between the components.

As described above, the grid electrode 124 is attached to the charging device 12 in a curved state so as to follow the curved outer peripheral surface of the photoconductor drum 11. Therefore, as illustrated in FIGS. 14 and 15, the distance h (h1, h2, and h3) from the grid electrode 124 to the outer peripheral surface of the photoconductor drum 11 is constant along both the rotation direction A of the photoconductor drum 11 and the axial direction of the photoconductor drum 11. In FIGS. 14 and 15, h shows the minimum distance from the opening portions 150A and 150B of the grid electrode 124 to the outer peripheral surface of the photoconductor drum 11. Specifically, h1 shows the minimum distance from the opening portion 150A at a position near the long-side outer frame portions 161, h2 shows the minimum distance from the opening portion 150A at a position near the central frame portion 163, h3 shows the minimum distance from the opening portion 150B at a position near the central frame portion 163, and h4 shows the minimum distance from the opening portion 150B at a position near the long-side outer frame portions 162.

When the charging device 12 is attached to the image forming apparatus 1, the corona discharge wires 123A and 123B are connected to a power supply that supplies a charging voltage and the grid electrode 124 is connected to a power supply that supplies a potential adjusting voltage. In the image forming operation, the charging voltage is supplied to the corona discharge wires 123A and 123B and the potential adjusting voltage is supplied to the grid electrode 124 in the charging device 12. Accordingly, the corona discharge wires 123A and 123B generate corona discharge while forming electric fields between the outer peripheral surface of the photoconductor drum 11 and the corona discharge wires 123A and 123B. As a result, the outer peripheral surface of the photoconductor drum 11 is charged by receiving predetermined electric charges. The charging potential of the photoconductor drum 11 is adjusted by the potential adjusting function of the grid electrode 124.

In the image forming apparatus 1 including the imaging devices 10 (S1, S2, Y, M, C, and k) which each include the above-described charging device 12, as described above, the grid electrode 124 in each charging device 12 is arranged so as to face the outer peripheral surface of the photoconductor drum 11 with a substantially constant distance therebetween. Therefore, in the charging process, potential control may be evenly and appropriately performed by using the grid electrode 124. As a result, the photoconductor drum 11 may be appropriately charged and uneven charging along the axial direction of the photoconductor drum 11 may be suppressed. Therefore, in the image forming apparatus 1, uneven density distribution due to uneven charging in a direction corresponding to the axial direction of the photoconductor drum 11 may be suppressed. As a result, a high-quality image in which uneven density distribution is suppressed may be formed.

Second Exemplary Embodiment

Figure 16:
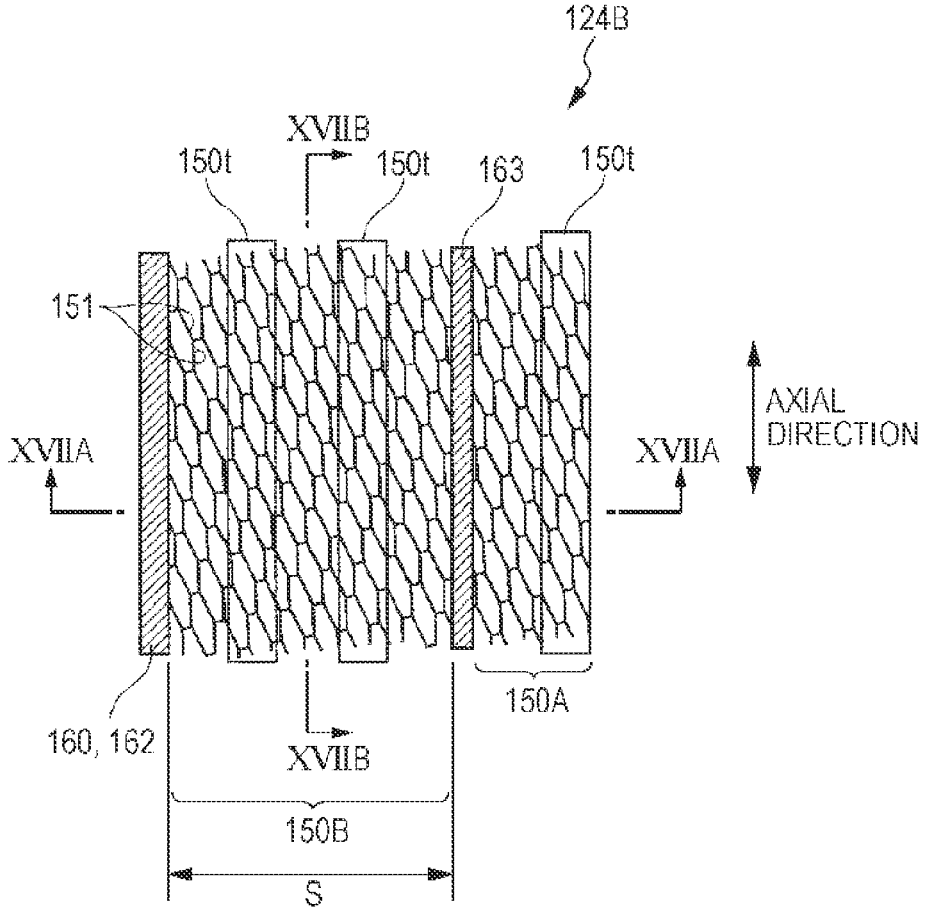
FIG. 16 is a plan view illustrating a part of a grid electrode according to a second exemplary embodiment.
Figure 17A:
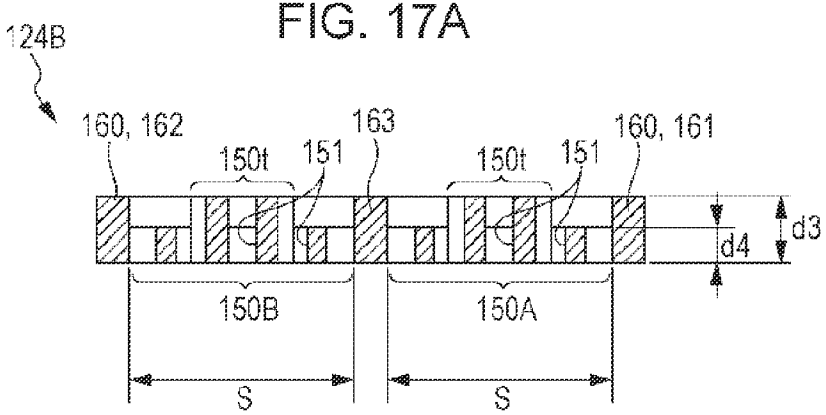
FIGS. 17A and 17B are sectional views of the grid electrode illustrated in FIG. 16 taken along lines XVIIA-XVIIA and XVIIB-XVIIB, respectively.
Figure 17B:
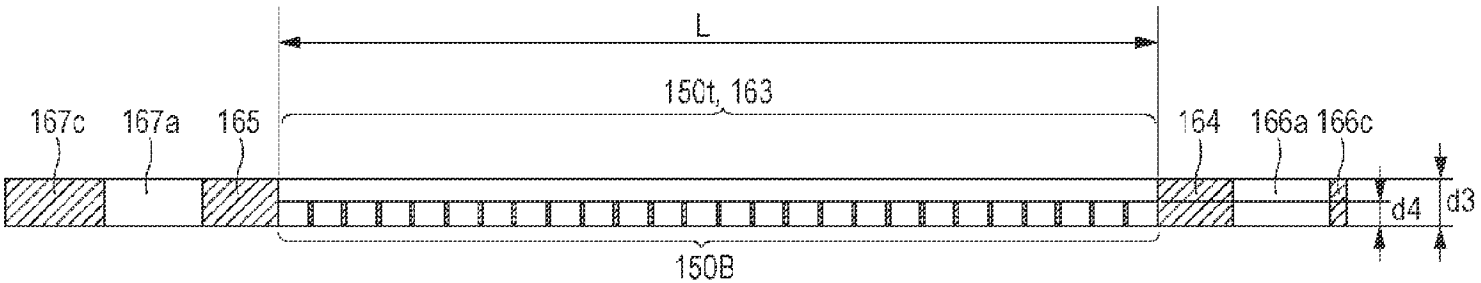

FIGS. 16, 17A, and 17B illustrate a grid electrode 124B according to a second exemplary embodiment. FIG. 16 is a plan view of a part of the grid electrode 124B. FIGS. 17A and 17B are sectional views of FIG. 16 (or FIG. 8) taken along lines XVIIA-XVIIA and XVIIB-XVIIB, respectively.

In the grid electrode 124B according to the second exemplary embodiment, the thickness d3 of the entire body of the frame section 160 (the long-side outer frame portions 161 and 162, the central frame portion 163, the short-side outer frame portions 164 and 165, and the attachment frame portions 166 and 167) and certain portions 150*t* of the opening section 150 is set so as to be greater than the thickness d4 of the portions of the opening section 150 other than the thick portions 150*t* (d3>d4). Thus, the entire body of the frame section 160 and the thick portions 150*t* of the opening section 150 are configured as "relatively thick portions". The thick portions 150*t* of the opening section 150 are arranged in a striped pattern in which linear strip-shaped areas that are substantially parallel to the axial direction of the photoconductor drum 11 are arranged next to each other.

In this case, portions of the opening section 150 other than the thick portions 150*t* serve as relatively thin portions. The relatively thin portions of the opening section 150 are also arranged in a striped pattern in which linear strip-shaped areas that are substantially parallel to the axial direction of the photoconductor drum 11 are arranged next to each other.

In the grid electrode 124B, the entire body of the frame section 160 and certain portions 150*t* of the opening section 150 are formed as relatively thick portions that are thicker than the remaining portions (remaining portions of the opening section 150). Therefore, when the grid electrode 124B is attached to the charging device 12 at a predetermined position in a manner similar to the manner in which the grid electrode 124 of the first exemplary embodiment is attached, the number of beams (thick portions 150*t*) that extend in the axial direction in the opening section 150 (150A and 150B) is increased and the area of the thin portions is reduced compared to those in the grid electrode 124 of the first exemplary embodiment. Accordingly, the tension F1 applied by the tension-applying springs 125 is transmitted mainly through the frame section 160 and the thick portions 150*t* of the opening section 150 of the grid electrode 124, and is substantially evenly distributed to the relatively thin portions of the opening section 150 through the long-side outer frame portions 161 and 162, the central frame portion 163, and the thick portions 150*t* of the opening section 150, which surround the relatively thin portions so as to sandwich the relatively thin portions.

As a result, the short-side outer frame portions 164 and 165 of the grid electrode 124B respectively come into tight contact with the curve reference surfaces 131*a* and 141*a* of the curve-regulating portions 131 and 141 while being interposed between the curve reference surfaces 131*a* and 141*a* and the pressing surface portions 126*a* of the curve-retaining members 126A and 126B. Thus, the grid electrode 124B is retained in a curved state so as to follow the curved outer peripheral surface of the photoconductor drum 11. As described above, the tension F1 is substantially evenly distributed to the thin portions of the opening section 150 while the thin portions are sandwiched between the thick frame section 160 and the thick portions 150*t* of the opening section 150. Therefore, although the openings 151 in the opening portions 150A and 150B are arranged in a mesh pattern, that is, an arrangement pattern in which portions between the openings 151 obliquely cross the axial direction of the photoconductor drum 11, the grid electrode 124B may be retained in a curved state so as to accurately follow the curved outer peripheral surface of the photoconductor drum 11. Here, the state in which the grid electrode 124B is appropriately curved is uniform along the axial direction of the photoconductor drum 11. In addition, bending of the grid electrode 124B in the curved state and vibrations due to the grid electrode 124B being thin may be suppressed.

Evaluation Tests

Evaluation tests carried out by using the grid electrodes 124 and 124B according to the first and second exemplary embodiments will now be described.

The evaluation tests are performed by attaching the grid electrodes 124 and 124B to be tested to the charging device 12 under the same condition (tension applied by the tension-applying springs 125 is set so that the spring constant is 9.5 gf/mm) and observing the curved surface shape of the grid electrodes 124 and 124B. Referring to FIGS. 14 and 15, the actual shape of the curved surface of each grid electrode along the rotation direction A of the photoconductor drum 11 is measured by a laser displacement meter at three measurement positions (OUT, CENTER, and IN) on the grid electrode in the axial direction of the photoconductor drum 11. The curved states of the grid electrodes 124 and 124B measured at the measurement positions (measurement results) are shown by the solid lines (GRID) in FIGS. 18B and 19B.

Figure 18A:
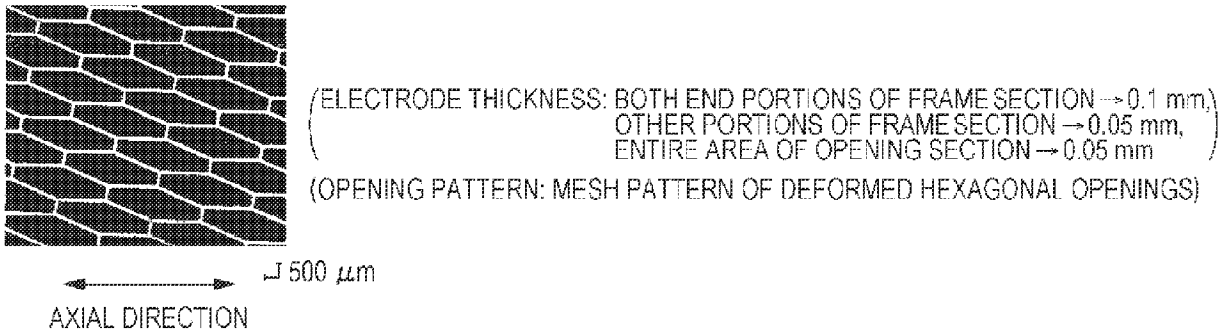
FIG. 18A illustrates conditions of an evaluation test in which the grid electrode according to the first exemplary embodiment is used.
Figure 18B:
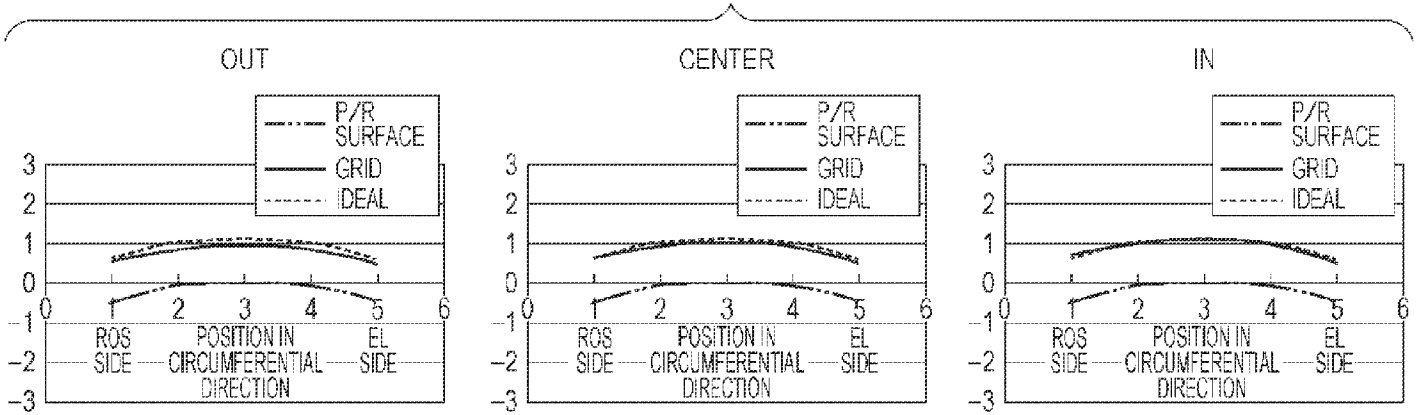
FIG. 18B shows graphs of the results of the evaluation test.

FIG. 18A illustrates a black-white inverted image of a part of the opening pattern. The white lines show the portions that form the opening pattern and the black areas shown the openings. This also applies to the following drawings. In FIG. 18B and other drawings, the state of the outer peripheral surface of the photoconductor drum 11 is shown by two-dot chain lines (P/R SURFACE), and the ideal state of the curved surface of the grid electrode is shown by dotted lines (IDEAL). The ideal state is the state in which the curvature of the curved surface is the same as that of the outer peripheral surface of the photoconductor drum 11. In FIG. 18B and other figures, "POSITION IN CIRCUMFERENTIAL DIRECTION" is the position on the outer peripheral surface along the rotation direction of the photoconductor drum 11, "ROS SIDE" is the side at which the exposure device 13 is disposed, and "EL SIDE" is the side at which the electricity removing device 18 is disposed. In FIG. 18B and other figures, it is desirable that the measurement results (solid lines) that show the actual curved states of the grid electrodes 124 and 124B be close to the dotted lines that show the ideal curved states.

The grid electrode 124 according to the first exemplary embodiment is a plate-shaped electrode made of stainless steel (SUS 304) having the shape illustrated in FIGS. 8, 9, 10A, and 10B. The thickness d1 of both end portions of the frame section 160, that is, the short-side outer frame portions 164 and 165 and the attachment frame portions 166 and 167, is 0.1 mm and the thickness d2 of the remaining portions of the frame section 160, that is, the long-side outer frame portions 161 and 162 and the central frame portion 163, and the opening section 150 is 0.05 mm. The opening portions 150A and 150B are rectangular areas whose length L in the long-side direction, that is, the axial direction of the photoconductor drum 11 is about 337 mm and whose length S in the short-side direction, that is, the rotation direction A of the photoconductor drum 11 is about 14 mm. The openings 151 in the opening section 150 are arrange in a pattern illustrated in, for example, FIG. 9 in which the openings 151 have a deformed hexagonal shape whose lengths in the long-side and short-side directions are about 3.6 mm and about 1.4 mm, respectively. The openings 151 are arranged next to each other so that the long-side direction thereof obliquely crosses the axial direction of the photoconductor drum 11 at an angle of about 10°. The opening rate of the opening section 150 over the entire area thereof is about 86%. The measurement result of the grid electrode 124 is illustrated in FIG. 18B.

The grid electrode 124B according to the second exemplary embodiment is a plate-shaped electrode made of stainless steel (SUS 304) having the shape illustrated in, for example, FIGS. 10A, 10B, 16, 17A, and 17B. The thickness d3 of the entire body of the frame section 160 and the thick portions 150*t* of the opening section 150 is 0.1 mm and the thickness d4 of portions of the opening section 150 other than the thick portions 150*t* is 0.05 mm. Referring to FIG. 20A, the width w1 of the thick portions 150*t* of the opening section 150 (dimension in the rotation direction A of the photoconductor drum 11) is about 2.5 mm. The width w2 of thin portions of the opening section 150 other than the thick portions 150*t* is about 3.0 mm. The dimensions and the opening pattern of the opening portions 150A and 150B are the same as those in the grid electrode 124 according to the first exemplary embodiment. The measurement result of the grid electrode 124B is illustrated in FIG. 19B.

Figure 19A:
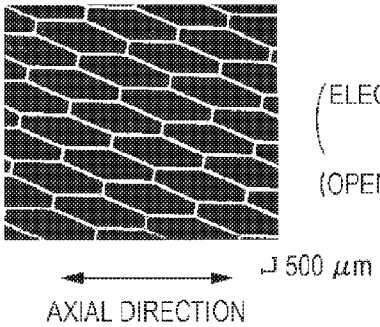
FIG. 19A illustrates conditions of an evaluation test in which the grid electrode according to the second exemplary embodiment is used.
Figure 19B:
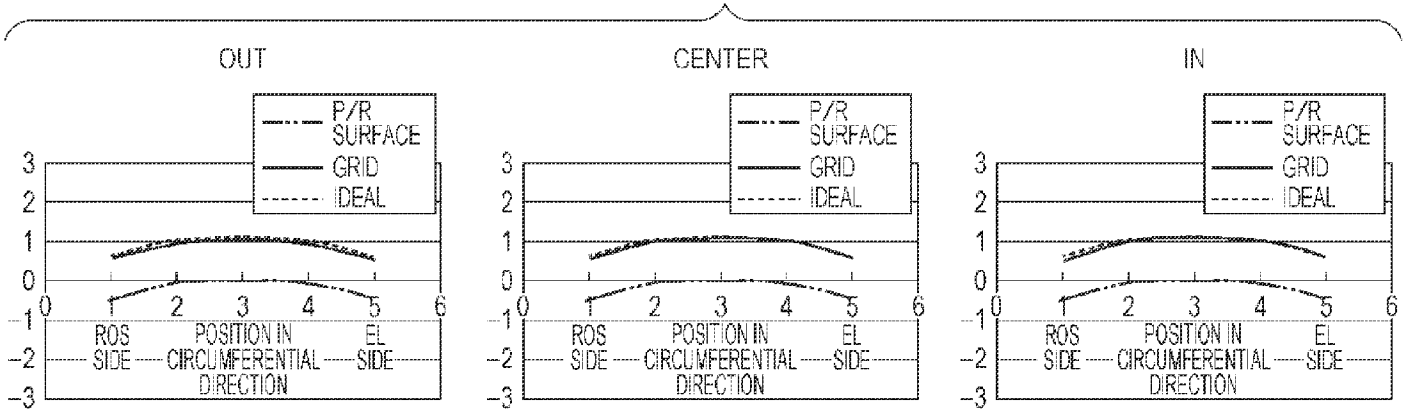
FIG. 19B shows graphs of the results of the evaluation test.
Figure 20A:
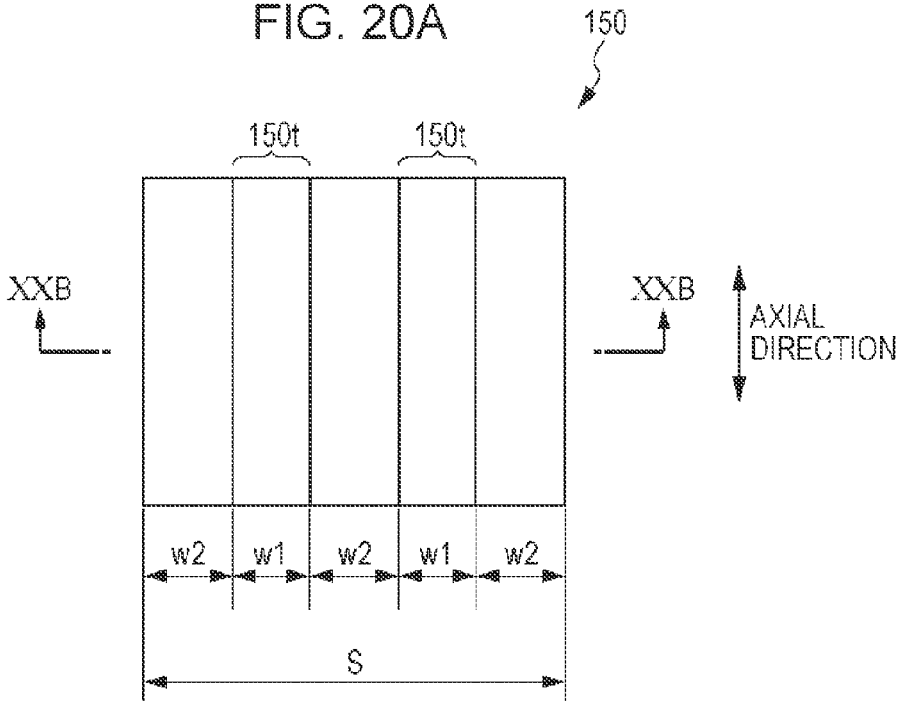
FIG. 20A is a plan view of a part of the grid electrode according to the second exemplary embodiment used in the evaluation test illustrated in FIGS. 19A and 19B.
Figure 20B:
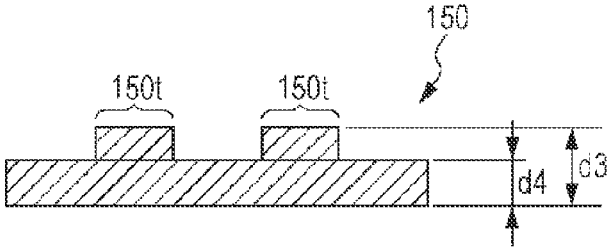
FIG. 20B is a sectional view of FIG. 20A taken along line XXB-XXB.

It is clear from the results illustrated in FIGS. 18B and 19B that the grid electrodes 124 and 124B are curved into a surface shape that follows the outer peripheral surface of the photoconductor drum 11 at any position in the axial direction of the photoconductor drum 11. In particular, the result obtained by the grid electrode 124B according to the second exemplary embodiment is more favorable than that obtained by the grid electrode 124 according to the first exemplary embodiment (see FIG. 19B). The present inventors carry out experiments in which, in the image forming apparatus 1 including the charging device 12 to which the grid electrodes 124 and 124B are attached, the distance h (see FIG. 15) from the grid electrodes 124 and 124B to the outer peripheral surface of the photoconductor drum 11 is reduced to, for example, about 1 mm, to increase the charging performance. As a result, it is found that the grid electrodes 124 and 124B hardly vibrate in the charging operation even when the tension applied by the tension-applying springs 125 is not increased.

Figure 25A:
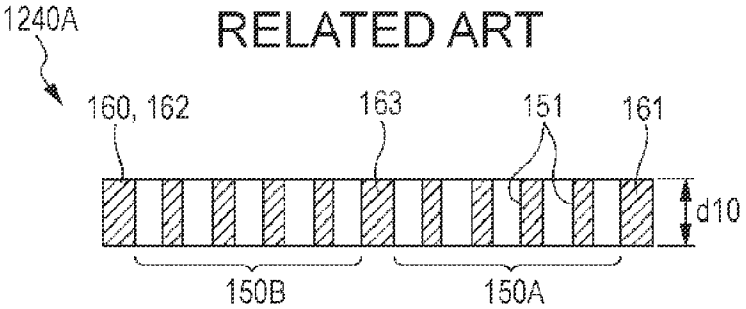
FIG. 25A RELATED ART
FIGS. 25A and 25B are sectional views corresponding to FIGS. 17A and 17B, respectively, illustrating a grid electrode according to a first comparative example.
Figure 25B:
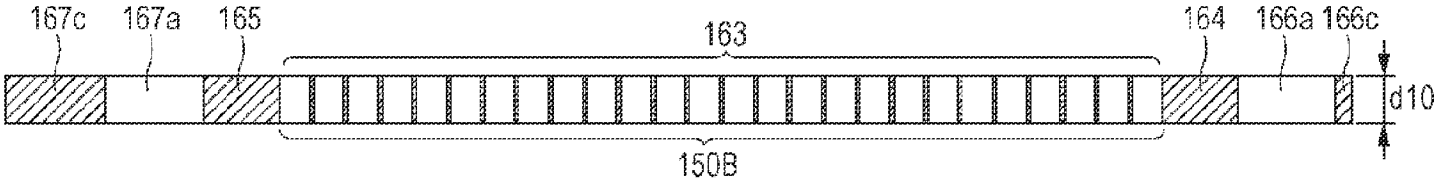
FIG. 25B RELATED ART

For comparison, a similar evaluation test is performed by using a grid electrode 1240A in which the thickness d10 of the opening section 150 and the frame section 160 is 0.1 mm over the entire areas thereof, as illustrated in FIGS. 25A and 25B (first comparative example). Other structures of the grid electrode 1240A are similar to those of the grid electrode 124 according to the first exemplary embodiment (this also applies to the following comparative examples). The result of the evaluation test is shown in FIG. 26B.

Figure 26A:
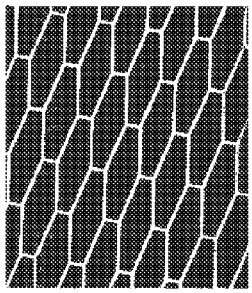
FIG. 26A RELATED ART
FIG. 26A illustrates conditions of an evaluation test in which the grid electrode according to the first comparative example is used.
Figure 26B:
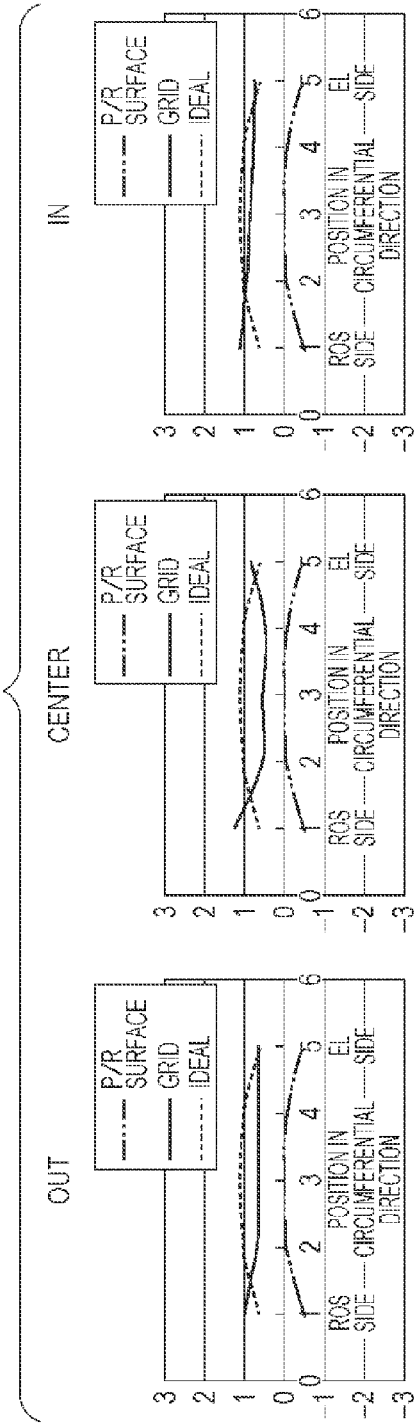
FIG. 26B RELATED ART
FIG. 26B shows graphs of the results of the evaluation test.

It is clear from the result illustrated in FIG. 26B that the grid electrode 1240A according to the first comparative example is not curved into the surface shape that corresponds to the outer peripheral surface of the photoconductor drum 11 over the entire area thereof. In particular, the grid electrode 1240A is flat in the central area thereof in the rotation direction of the photoconductor drum 11.

Figure 27A:
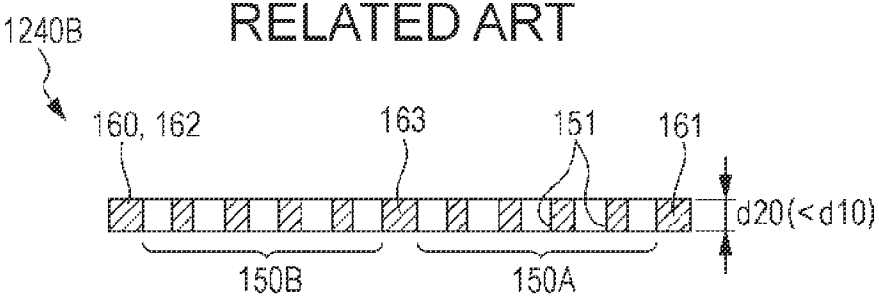
FIG. 27A RELATED ART
FIGS. 27A and 27B are sectional views corresponding to FIGS. 17A and 17B, respectively, illustrating a grid electrode according to a second comparative example.
Figure 27B:
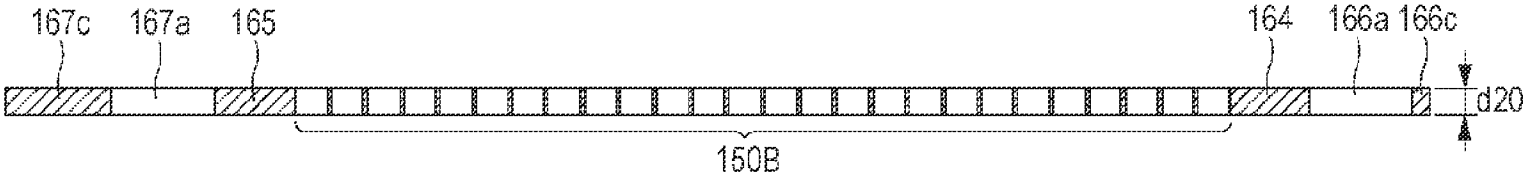
FIG. 27B RELATED ART

In addition, a similar evaluation test is performed by using a grid electrode 1240B in which the thickness d20 of the opening section 150 and the frame section 160 is 0.05 mm over the entire areas thereof, as illustrated in FIGS. 27A and 27B (second comparative example). The grid electrode 1240B differs from the grid electrode 1240A according to the first comparative example in that the thickness d20 is smaller than the thickness d10 (d20<d10). The result of the evaluation test is shown in FIG. 28B.

Figure 28A:
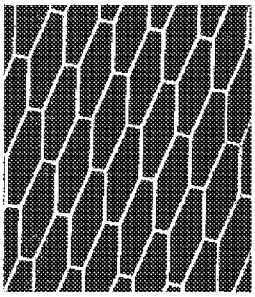
FIG. 28A RELATED ART
FIG. 28A illustrates conditions of an evaluation test in which the grid electrode according to the second comparative example is used.
Figure 28B:
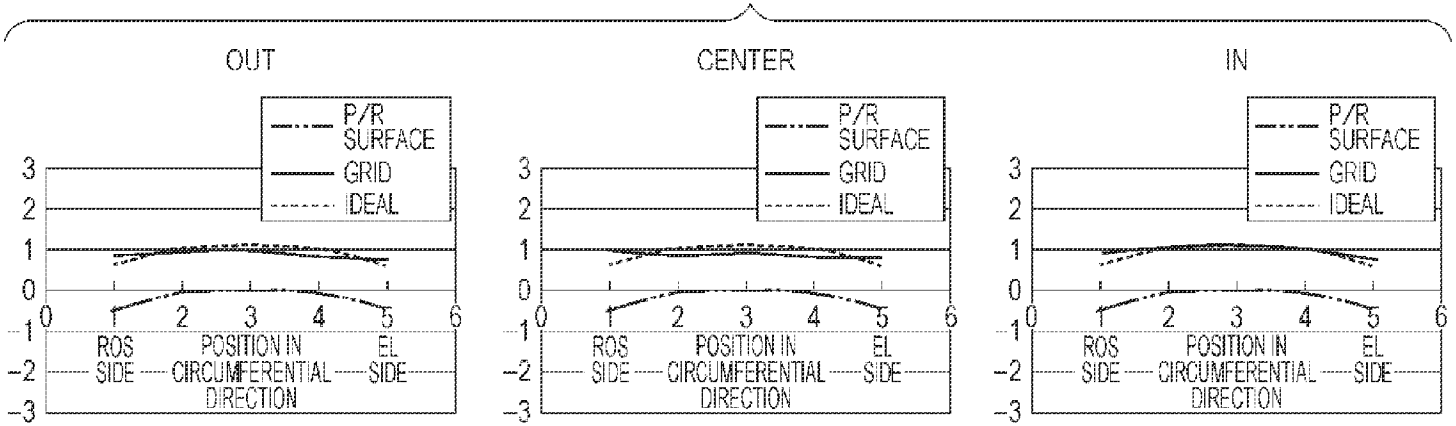
FIG. 28B RELATED ART
FIG. 28B shows graphs of the results of the evaluation test.

As is clear from the result illustrated in FIG. 28B, unlike the grid electrode 1240A of the first comparative example, the grid electrode 1240B of the second comparative example is curved into the surface shape that corresponds to the outer peripheral surface of the photoconductor drum 11 at positions other than CENTER. In addition, it has been found that, before the two curve-retaining members 126A and 126B are attached to the grid electrode 1240B, one end portion of the grid electrode 1240B (portion including the short-side outer frame portion 164) warps and buckles so as to be separated from both ends of the curve reference surface 131*a* of the curve-regulating portion 131.

Figure 29:
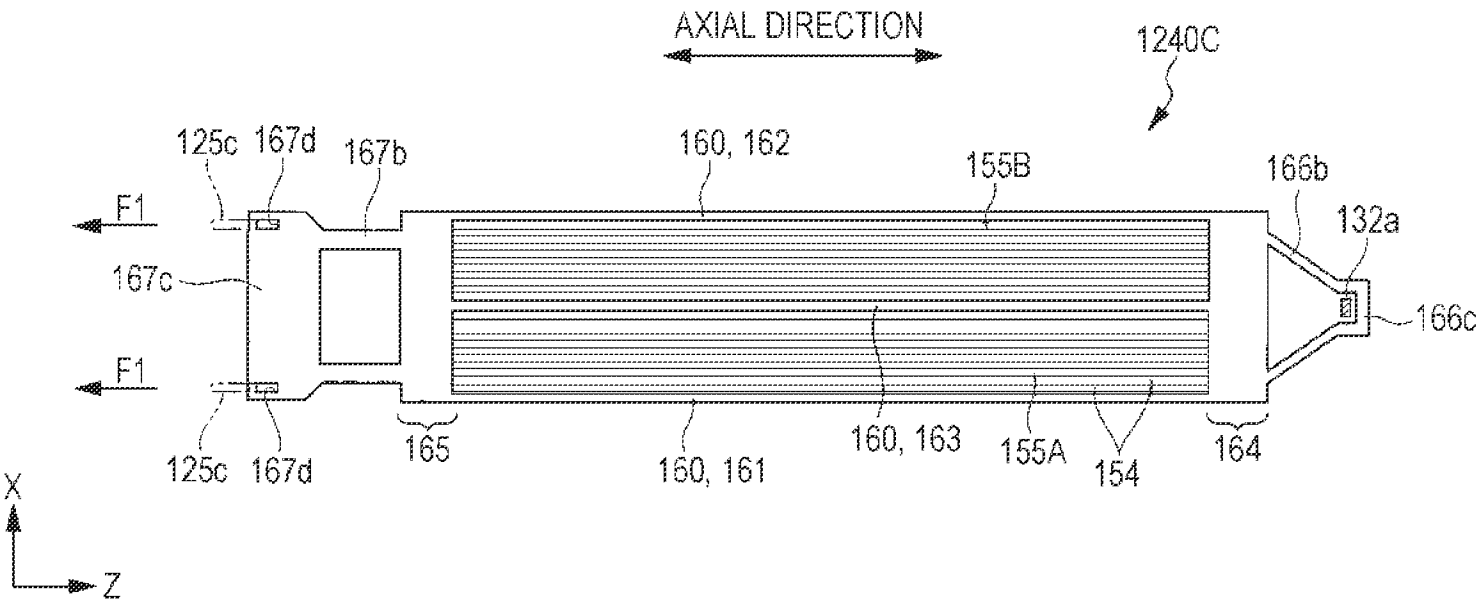
FIG. 29 RELATED ART
FIG. 29 is a sectional view illustrating a grid electrode according to a third comparative example.

In addition, a similar evaluation test is performed by using a grid electrode 1240C in which the thickness of the opening section 150 and the frame section 160 is 0.1 mm over the entire areas thereof and the opening section 150 includes opening portions 155A and 155B in which plural linear openings 154 that extend in the axial direction of the photoconductor drum 11 are arranged parallel to each other so as to form a striped pattern, as illustrated in FIG. 29 (third comparative example). In the grid electrode 1240C, the opening pattern of the opening section 150 differs from the opening pattern (mesh pattern) of the opening section 150 in the grid electrode 1240A according to the first comparative example. The result of the evaluation test is shown in FIG. 30B.

Figure 30A:
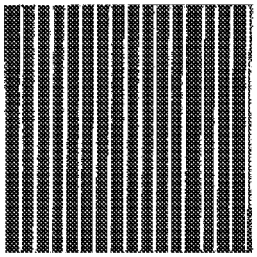
FIG. 30A RELATED ART
FIG. 30A illustrates conditions of an evaluation test in which the grid electrode according to the third comparative example is used.
Figure 30B:
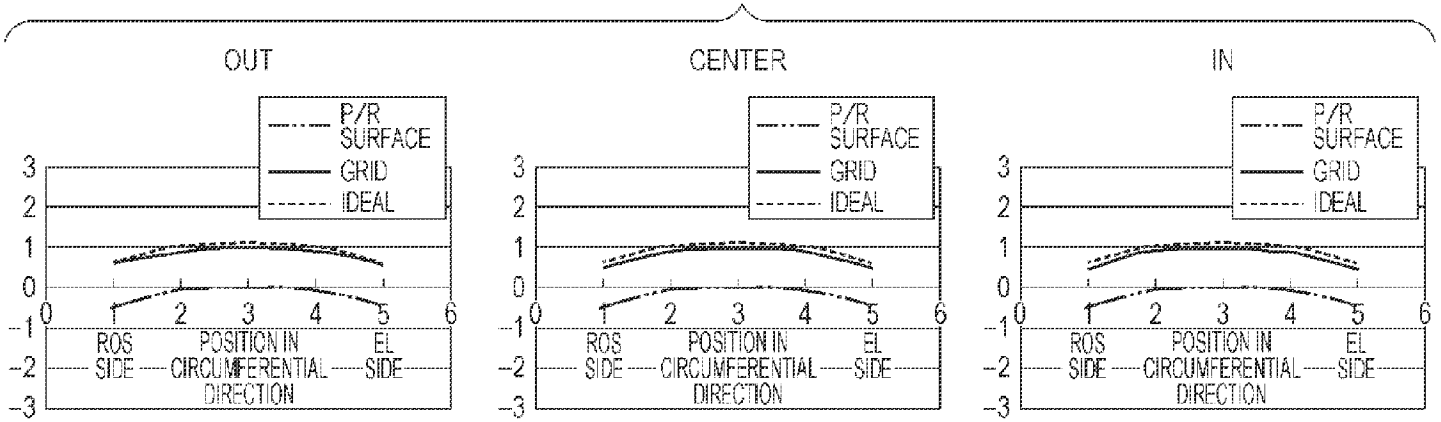
FIG. 30B RELATED ART
FIG. 30B shows graphs of the results of the evaluation test.

As is clear from the result illustrated in FIG. 30B, unlike the grid electrodes 1240A and 1240B of the first and second comparative examples, the grid electrode 1240C of the third comparative example is curved into the surface shape that corresponds to the outer peripheral surface of the photoconductor drum 11 over the entire area thereof. However, according to the grid electrode 1240C, when the distance h from the grid electrode 1240C to the outer peripheral surface of the photoconductor drum 11 is reduced to, for example, about 1 mm, to increase the charging performance, the grid electrode 1240C vibrates in the charging operation. The vibration of the grid electrode 1240C may be reduced by increasing the tension applied by the tension-applying springs 125 to, for example, a tension at which the spring constant is about 15 gf/mm. However, when the voltage applied to the grid electrode 1240C in the curved state is increased, the grid electrode 1240C vibrates and the curved shaped thereof cannot be maintained.

Other Exemplary Embodiments

Figure 21:
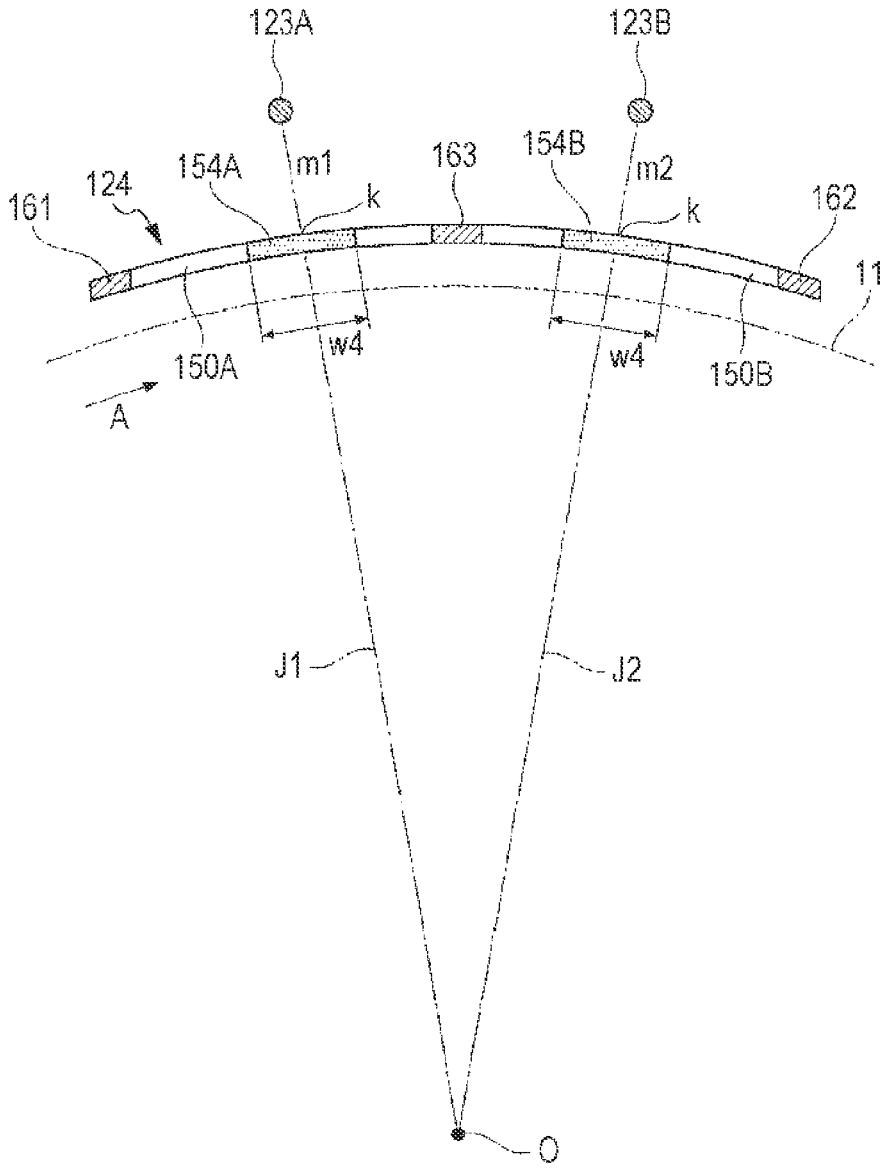
FIG. 21 illustrates a grid electrode having another structure.

As illustrated in FIG. 21, the grid electrode 124 may be formed such that the opening section 150 has the same thickness dx in areas 154A and 154B directly below the corona discharge wires 123A and 123B, respectively.

In this case, the areas 154A and 154B are areas centered on intersecting points k at which straight lines J1 and J2, which connect a rotation center O of the photoconductor drum 11 and the centers of the corona discharge wires 123A and 123B, intersect the opening portions 150A and 150B of the grid electrode 124. The width w4 of the areas 154A and 154B along the rotation direction A of the photoconductor drum 11 is set to, for example, the distance m1, m2 (m1=m2) from the corona discharge wires 123A and 123B to the grid electrode 124. The thickness dx of the opening section 150 in the areas 154A and 154B may be equal to the thickness of the relatively thick portions, the thickness of the relatively thin portions, or another thickness as long as the opening section 150 has the same constant thickness in the areas 154A and 154B.

In the charging device 12 to which the grid electrode 124 is attached, the distances from the areas 154A and 154B of the opening section 150 to the corona discharge wires 123A and 123B, respectively, do not largely differ from each other. Therefore, the corona discharge wires 123A and 123B are prevented from performing uneven discharging, which occurs when the distances differ from each other, and the charging process may be reliably performed.

Figure 22:
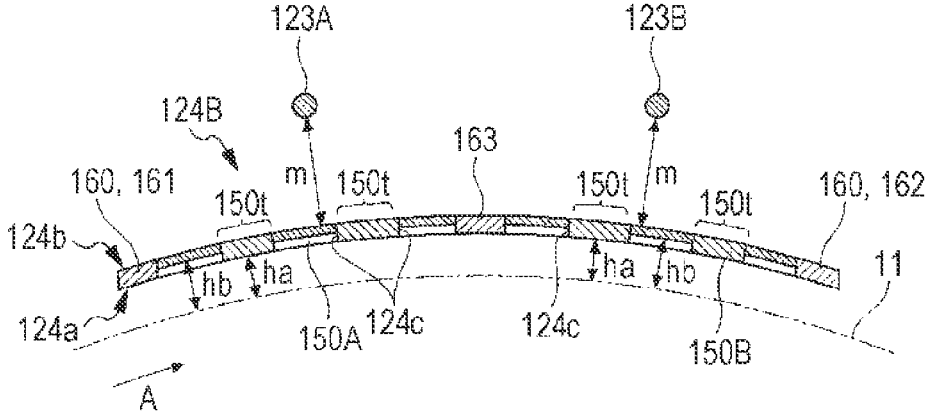
FIG. 22 illustrates a grid electrode having another structure.

Referring to FIG. 22, the grid electrode may include steps 124*c* formed between the relatively thick portions 150*t* and the other portions on one side 124*a* thereof, as in the grid electrode 124B according to the second exemplary embodiment. In such a case, the grid electrode is preferably arranged such that the side 124*a* on which the steps 124*c* are formed faces the outer peripheral surface of the photoconductor drum 11. In FIG. 22, reference sign 124*b* denotes the side that is free from the steps 124*c* (smooth side).

In the charging device 12 to which the grid electrode 124B having the side 124*a* on which the steps 124*c* are formed is attached, the distance h from the side 124*a* of the grid electrode 124B having the steps 124*c* to the outer peripheral surface of the photoconductor drum 11 differs between the distance ha of the thick portions 150*t* of the opening section 150 and the distance hb of the thin portions (ha<hb). However, the distance m from the side 124*b* that is free from the steps 124*c* to the corona discharge wires 123A and 123B do not largely vary. Therefore, uneven charging due to electric field concentration, which may occur if there is a variation in the distance m from the grid electrode 124B to the corona discharge wires 123A and 123B because of the steps 124*c*, may be suppressed. As a result, the charging process may be reliably performed.

In the grid electrode 124B according to the second exemplary embodiment, the width w1 and the number of the thick portions 150*t* of the opening section 150 and the intervals between the thick portions 150*t* (that is, the width w2 of the relatively thin portions) may be changed.

Figure 23A:
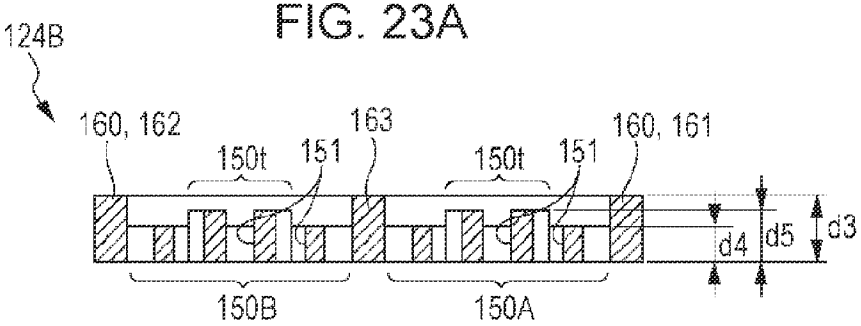
FIGS. 23A and 23B are sectional views corresponding to FIGS. 17A and 17B, respectively, illustrating a modification of the grid electrode according to the second exemplary embodiment.
Figure 23B:
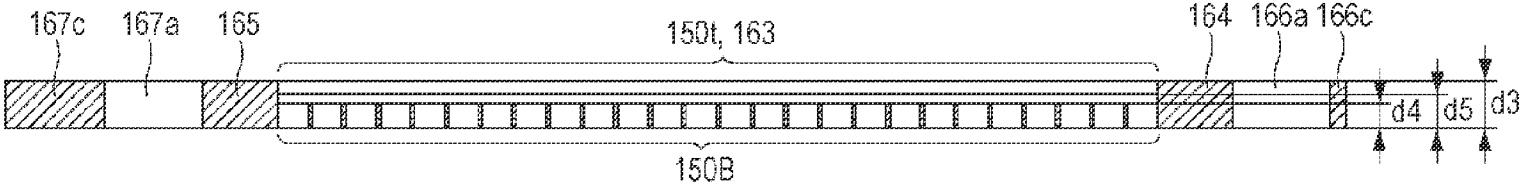

In the grid electrode 124B, as illustrated in FIGS. 23A and 23B, the thickness d5 of the thick portions 150*t* of the opening section 150 may be smaller than the thickness d3 of the frame section 160 (d5<d3). However, the thickness d5 of the thick portions 150*t* is set to be greater than the thickness d4 of the relatively thin portions of the opening section 150 (d5>d4). Also in this case, the grid electrode 124B is attached to the charging device 12 in a curved state so as to accurately follow the curved outer peripheral surface of the photoconductor drum 11. The state in which the grid electrode 124B is appropriately curved is uniform along the axial direction of the photoconductor drum 11.

Figure 24:
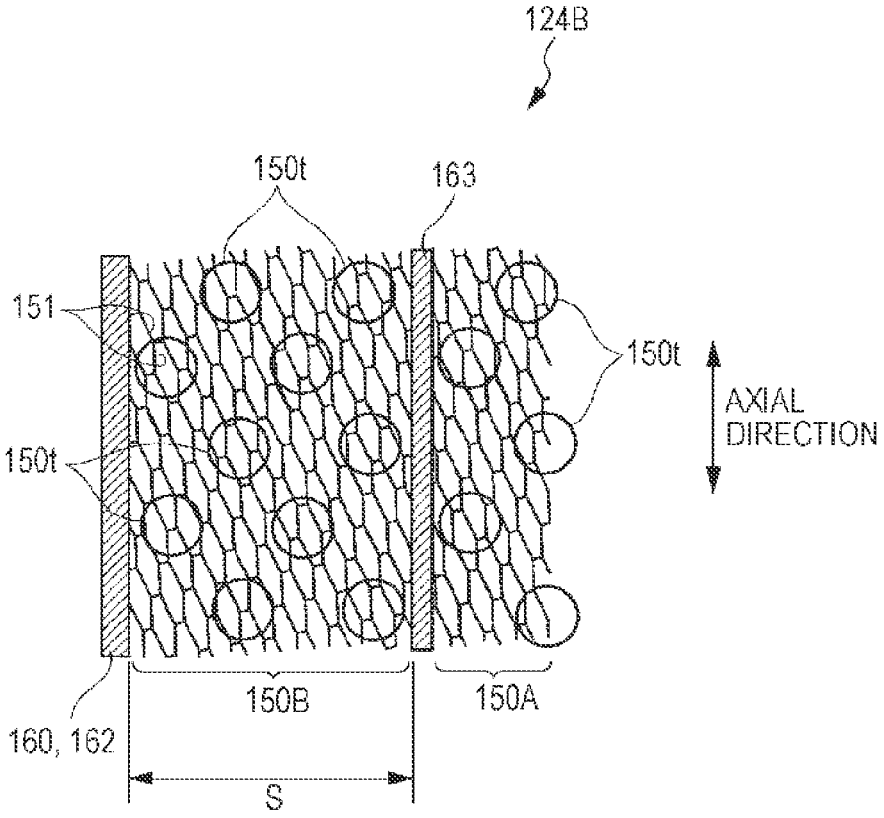
FIG. 24 is a diagram corresponding to FIG. 16, illustrating another modification of the grid electrode according to the second exemplary embodiment.

In this grid electrode 124B, the thick portions 150*t* of the opening section 150 may be formed in dot-shaped areas that are not continuous to each other, as illustrated in FIG. 24. Also in this case, the dot-shaped thick portions 150*t* may be arranged linearly in the axial direction of the photoconductor drum 11. Accordingly, relatively thin portions that continuously extend in the axial direction of the photoconductor drum 11 are provided between the groups of dot-shaped thick portions 150*t* that are linearly arranged in the axial direction of the photoconductor drum 11.

In the first and second exemplary embodiments, each end portion of the frame section 160 of the grid electrode 124, 124B may have an attachment portion to which the tension is applied at plural points, as in the attachment frame portion 167 at an end near the end support 122. When an attachment portion similar to the attachment frame portion 167 is provided at each end of the grid electrode, the entire body of the grid electrode may be retained in such a manner that the surface shape thereof is curved so as to follow the shape of the outer peripheral surface of the photoconductor drum 11. Even when the thickness of the attachment portions similar to the attachment frame portion 167 is reduced, the grid electrode may be retained in such a manner that the surface shape thereof is curved so as to follow the shape of the outer peripheral surface of the photoconductor drum 11 without using the curve-retaining members 126A and 126B.

The opening pattern of the opening section 150 of the grid electrode is not particularly limited as long as plural openings 151 are regularly or randomly arranged in a certain arrangement pattern, the openings 151 being suitable for performing a control so that the outer peripheral surface of the photoconductor drum 11 may be charged to a substantially uniform potential by the corona discharge generated by the corona discharge wires 123A and 123B. The exemplary embodiments of the present invention are particularly suitable for a grid electrode having an opening pattern in which connecting portions between the openings obliquely cross the axial direction of the photoconductor drum 11. The frame section 160 of the grid electrode may be free from the central frame portion 163 or have other structures.

According to the first and second exemplary embodiments, the grid electrode 124, 124B is flat when it is not attached to the charging device 12. However, the grid electrode may instead have a curved shape close to that of the outer peripheral surface of the photoconductor drum 11 in advance if the grid electrode may be easily and appropriately retained in such a manner that the surface shape thereof is curved so as to follow the shape of the outer peripheral surface of the photoconductor drum 11.

The charging device 12 includes, as curve-regulating members that retain the grid electrode in a curved state, curve-regulating portions 131 and 141 that are integrated with the support bodies of the end supports 121 and 122, respectively. However, the curve-regulating members may instead be formed separately from the end supports 121 and 122. In the case where the grid electrode 124, 124B may be retained in such a manner that the surface shape thereof is curved so as to follow the shape of the outer peripheral surface of the photoconductor drum 11 without using the curve-retaining members 126A and 126B, the curve-retaining members 126A and 126B may be omitted from the charging device 12. Although the charging device 12 includes two corona discharge wires 123A and 123B, the number of corona discharge wires included in the charging device 12 may instead be one, three, or more.

The structure, such as type, of the image forming apparatus 1 including the charging device 12 according to the exemplary embodiments of the present invention is not particularly limited as long as the charging device 12 may be incorporated in the image forming apparatus 1. The image forming apparatus 1 may have a known structure. For example, the image forming apparatus may include a photoconductor belt instead of the photoconductor drum 11. In this case, the charging device 12 is arranged so as to face an outer peripheral portion of the photoconductor belt that is wound around a belt support roller and held in a curved state. In the case where the charging device 12 is capable of performing high-speed charging, the photoconductor drum 11 may have a surface protecting layer for increasing the durability or the like of the photoconductor drum 11. The object to be charged by the charging device 12 is not limited to the photoconductor drum 11 as long as the object is a rotating body that includes a curved outer peripheral portion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A grid electrode that is substantially thin-plate-shaped, comprising:

an opening section having a plurality of openings; and a frame section that surrounds the opening section, wherein the grid electrode is curved along a short-side direction thereof and includes portions having different thicknesses, the portions being arranged in the short-side direction.

2. The grid electrode according to claim 1, wherein a thickest part of the frame section is thicker than a thickest part of the opening section.

3. The grid electrode according to claim 2, wherein the thickest part of the opening section is thicker than a thinnest part of the frame section.

4. The grid electrode according to claim 1, wherein a thickest part of the opening section is arranged so as to extend substantially linearly in a long-side direction of the grid electrode.

5. The grid electrode according to claim 1, wherein the grid electrode extends in a long-side direction that is orthogonal to the short-side direction, and the grid electrode has different thicknesses in a thickness direction that is orthogonal to the long-side direction and the short-side direction.

6. The grid electrode according to claim 5, wherein a thickest part of the frame section in the thickness direction is thicker than a thickest part of the opening section in the thickness direction.

7. A photoconductor unit comprising:

an object to be charged; and a charging device that charges the object to be charged, wherein the charging device includes a charging member, and a grid electrode that is substantially thin-plate-shaped and disposed between the charging member and the object to be charged, the grid electrode including an opening section having a plurality of openings and a frame section that surrounds the opening section, wherein the grid electrode is curved along a short-side-direction thereof and includes portions having different thicknesses, the portions being arranged in the short-side direction, and wherein the grid electrode has a substantially uniform thickness at a position where the grid electrode intersects a line connecting the closest points of the charging member and the object to be charged.

8. The photoconductor unit according to claim 7, wherein the grid electrode extends in a long-side direction that is orthogonal to the short-side direction, and the grid electrode has different thicknesses in a thickness direction that is orthogonal to the long-side direction and the short-side direction.

9. The photoconductor unit according to claim 8, wherein a thickest part of the frame section in the thickness direction is thicker than a thickest part of the opening section in the thickness direction.

10. A charging device comprising:

a charging member, and a grid electrode that is substantially thin-plate-shaped, the grid electrode including an opening section having a plurality of openings and a frame section that surrounds the opening section, wherein the grid electrode is curved along a short-side direction thereof and includes portions having different thicknesses, the portions being arranged in the short-side direction.

11. The charging device according to claim 10, further comprising:

a curve-regulating member that has a curve reference surface having a surface shape that corresponds to a curved surface shape of an outer peripheral portion of an object to be charged, at least a part of end portions of the frame section of the grid electrode in an axial direction of the object to be charged being brought into contact with the curve reference surface and retained in a curved state; and a tension-applying member that applies a tension to at least one of the end portions of the frame section of the grid electrode in the axial direction of the object to be charged, the tension being applied in the axial direction of the object to be charged.

12. The charging device according to claim 11, further comprising:

a curve-retaining member that presses at least the part of the end portions of the frame section of the grid electrode in the axial direction of the object to be charged against the curve reference surface of the curve-regulating member.

13. The charging device according to claim 10, wherein the grid electrode includes a step on one side thereof, the step being formed between a thick portion and a portion other than the thick portion, and is arranged such that the side on which the step is formed faces an outer peripheral portion of an object to be charged.

14. An image forming apparatus, comprising:

an object to be charged that includes an outer peripheral portion having a curved surface shape and that rotates; and the charging device according to claim 10.

15. The charging device according to claim 10, wherein the grid electrode extends in a long-side direction that is orthogonal to the short-side direction, and the grid electrode has different thicknesses in a thickness direction that is orthogonal to the long-side direction and the short-side direction.

16. The photoconductor unit according to claim 15, wherein a thickest part of the frame section in the thickness direction is thicker than a thickest part of the opening section in the thickness direction.

* * * * *